US006349277B1

(12) United States Patent
Kamai et al.

(10) Patent No.: US 6,349,277 B1
(45) Date of Patent: Feb. 19, 2002

(54) METHOD AND SYSTEM FOR ANALYZING VOICES

(75) Inventors: Takahiro Kamai, Kyoto; Kenji Matsui, Ikoma, both of (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/429,962

(22) Filed: Oct. 29, 1999

Related U.S. Application Data

(62) Division of application No. 09/058,050, filed on Apr. 9, 1998.

(30) Foreign Application Priority Data

Apr. 9, 1997 (JP) ..... 9-090657
Oct. 13, 1997 (JP) ..... 9-278683

(51) Int. Cl.[7] ..... G10L 11/04

(52) U.S. Cl. ..... 704/207; 704/205

(58) Field of Search ..... 704/207, 205

(56) References Cited

U.S. PATENT DOCUMENTS 3,940,565 A 2/1976 Lindenberg
4,624,012 A 11/1986 Lin et al.
4,692,941 A 9/1987 Jacks et al.
4,707,857 A 11/1987 Marley et al.

(List continued on next page.)

FOREIGN PATENT DOCUMENTS

JP 5-265479 10/1993
JP 8-95589 4/1996

OTHER PUBLICATIONS

Charpentier et al., "Diphone Synthesis Using an Overlap–add Technique for Speech Waveforms Concatenation," ICASSP, Tokyo, pp. 2015–2018 (1986).

Kawai et al., "Constructing a waveform inventory for text–to–speech synthesis based on waveform splicing," Proc. Autumn Meeting Acoust. Soc. Japan, 3–5–5, pp. 325–326 (1994).

Sakamoto et al., "A new waveform overlap–add technique for text–to–speech synthesis," Technical Report of IEICE, SP95–6, pp. 39–45 (1995).

Arai et al., "A study on the optimal window position to extract pitch waveforms based on a speech signal model" Proc. Spring Meeting Acoust. Soc. Japan, 1–4–22, pp. 261–262 (1995).

(List continued on next page.)

*Primary Examiner*—Fan Tsang
*Assistant Examiner*—Michael N. Opsasnick
(74) *Attorney, Agent, or Firm*—Ratner & Prestia, PC

(57) ABSTRACT

It is to assign proper pitch marks to voice waveforms, thereby to obtain smoothly synthesized voices and to control pitches of voices very accurately according to pitch marks of recorded messages.

Any one of the fixed low-pass filters 3002-*a* to 3002-*d* is set so as to pass only fundamental component of voices and each of peak detectors 3003-*a* to 3003-*d* detects peaks and the channel selector 3004 is selected, thereby to keep taking out of peak information for fundamental waves. The channel selector 3004 decides a channel to be a correct channel if intervals of peaks detected by the peak detectors 3003-*a* to *d* are changed smoothly in the channel. According to this peak information, pitches of voices are analyzed, so that the adaptive filter 3005 passes only fundamental component of voices and the peak detector 3006 detects peaks of fundamental waves, thereby to assign pitch marks to voice waveforms.

17 Claims, 14 Drawing Sheets

U.S. PATENT DOCUMENTS

| | | | |
|---|---|---|---|
| 4,783,807 | A | 11/1988 | Marley |
| 5,220,629 | A | 6/1993 | Kosaka et al. |
| 5,231,397 | A | 7/1993 | Ridkosil |
| 5,278,943 | A | 1/1994 | Gasper et al. |
| 5,384,893 | A | 1/1995 | Hutchins |
| 5,563,952 | A | 10/1996 | Mercer |
| 5,572,593 | A | 11/1996 | Nejime et al. |
| 5,715,368 | A | 2/1998 | Saito et al. |
| 5,729,694 | A | 3/1998 | Hoizrichter et al. |
| 5,740,320 | A | 4/1998 | Itoh |
| 5,774,995 | A | 7/1998 | Borchardt et al. |
| 5,860,064 | A | 1/1999 | Henton |
| 5,864,812 | A | 1/1999 | Kamai et al. |
| 5,913,193 | A | 6/1999 | Huang et al. |
| 5,913,194 | A | 6/1999 | Karaali et al. |
| 5,966,690 | A | 10/1999 | Fujita et al. |
| 5,970,453 | A | 10/1999 | Sharman |

OTHER PUBLICATIONS

Ohmura et al., "Fine pitch contour extraction by voice fundamental wave filtering method," Journal of Acoust. Soc. Japan, vol. 51, No. 7, pp. 509–518 (1995).

Ross et al., "Average Magnitude Difference Function Pitch Extractor," IEEE Transactions on Acoustics, Speech, and Signal Processing, vol. ASSP–22, No. 5, pp. 353–362 (1974).

METHOD AND SYSTEM FOR ANALYZING VOICES

This application is a Division of Ser. No. No. 09/058,050 filed Apr. 9, 1998.

BACKGROUND OF THE INVENTION

1. Field of the Invention

The present invention relates to a method for analyzing pitches and powers of voices in detail, a method and a medium for synthesizing high quality voices, and compressing and encoding voices efficiently using the analyzing method.

2. Related Art of the Invention

An object of a voice synthesizing system is to synthesize given contents of a voice as voice waveforms. There have been invented various methods for synthesizing voices so far. A representative method among them is a waveform editing and synthesizing method that stores voice waveforms in a fine unit in advance (in synthesis units), then select and connect proper units appropriately to target contents.

In such a voice synthesizing method, feelings of discontinuation and wrongness generated when units are connected can be lowered by changing the pitch and the time length of each unit, thereby to synthesize voices smoothly. One of the well-known methods for changing pitches and time lengths such way is, for example, the PSOLA (Pitch Synchronous Overlap Add) method (F. Charpentier, M. Stella, "Diphone synthesis using an over-lapped technique for voice waveforms concatenation", Proc. ICASSP, 2015-2018, Tokyo, 1986). In this method, pitch marks are assigned to local peak positions and glottal closures of unit waveforms in advance, so that pitch waveforms are selected out around each of those pitch-marked positions using a window function. Voices are thus synthesized properly.

As a pitch marking method used for voice synthesizing as described above, there are methods in which pitch marks are assigned to local peaks of time waveforms and to glottal closures. An example of the method for assigning pitch marks to local peaks of time waveforms is introduced in "Constructing a Waveform Inventory for Text-to-Speech Synthesis Based on Waveform Splicing" (Proc. Autumn Meeting Acoust. Soc. Japan, 3-5-5, 1994-11). The advantage of this method is simplicity. For complicated voice waveforms including many high frequency components, however, it is difficult to assign a pitch mark to each pitch cycle. In addition, the peak itself has a time fluctuation caused by such high frequency components. Consequently, synthesized waveforms have a phase fluctuation in each pitch cycle. This then arises a problem of thick voices, which makes listeners feel uncomfortable.

On the other hand, a method for assigning pitch marks to glottal closures of voice waveforms is introduced in M. Sakamoto et al.: "A New Waveform Overlap-Add Technique for Text-to-Speech Synthesis", Technical Report of IEICE SP95-6 (1995-05) and by Y. Arai et al.: "A Study on the Optimal Window Position to Extract Pitch Waveforms Based on a Speech Signal Model.", Proc. Spring meeting Acoust. Soc. Japan, 1-4-22, 1995-3. In the method, voice waveforms are analyzed using a wavelet transform method and a linear prediction analysis method, thereby to presume a glottal closure timing and assign a pitch mark to the timing position. The glottal closure extracting method has an advantage that one pitch mark can be assigned accurately to each pitch cycle. Since this method is equivalent to a method for selecting out response waveforms corresponding to glottal closure pulses, pitch waveforms can be selected out with less spectrum distortion. The method is thus favorable from the viewpoint of selecting out waveforms. This method, however, has a problem that the method for analyzing and presuming glottal closure is complicated.

In addition to those methods, there is also a technology for extracting fundamental component of a voice using an FIR linear phase band-pass filter that specifies a passing band around the voice pitch frequency adaptively and partitioning the voice waveform for each pitch cycle using a zero-cross position. The technology is introduced in "Fine Pitch Contour Extraction by voice Fundamental Wave Filtering Method", Journal of Acoust. Soc. Japan, Vol.51, No.7, pp.509–518, 1995. This method is used to analyze fine pitches, but it is also used to find pitch cycles synchronizing with fundamental waveform.

A partitioning point extracted by the above method is not related directly to any of local peaks and glottal closures of voice waveforms. It is not proper therefore to use such a partitioning point as a pitch mark with no change sometimes.

As described above, the method for using a local peak on time waveforms as a pitch mark has a problem that thick voices are generated in synthesized voices, since the pitch mark includes a fluctuation generated around each peak of time waveforms. And, the method for using a glottal closures as a pitch mark has a problem that the processing for presuming glottal closures is complicated. In addition, the method for filtering fundamental component also has a problem that a proper timing to be used as a pitch mark cannot be extracted.

SUMMARY OF THE INVENTION

Under such the circumstances, it is an object of the present invention to provide a method for analyzing voices, which can assign pitch marks more simply and more properly than related arts and a method and a medium for synthesizing higher quality voices than the related arts.

One aspect of the method according to the invention is for analyzing voices which generates pitch mark information assumed to be time reference positions corresponding to a pitch cycle of voice waveforms, by using means for storing voice waveforms; means for analyzing pitches; an adaptive filter; and means for detecting peaks, wherein

- some of said voice waveforms are stored temporarily using said voice waveform storing means;
- rough pitch information is generated from said voice waveforms stored temporarily, by using said pitch analyzing means;
- said voice waveforms stored temporarily is entered to said adaptive filter and by changing a cut-off frequency or a center frequency of said adaptive filter according to said rough pitch information, only fundamental component extracted from the entered voice waveforms is passed; and
- plural maximum points are detected at one side of said basic waves by using said peak detecting means, thereby to generate a series of accurate pitch mark information for the whole voice waveforms.

A method of claim 2 is for analyzing voices, which generates pitch mark information assumed to be time reference positions corresponding to a pitch cycle of voice waveforms by using plural peak detecting channels each of which is a set of a fixed low-pass filter and a peak detecting means, and means for selecting a channel, wherein cut-off frequencies of said plural fixed low-pass filters are set so that at least one of said plural fixed low-pass filters passes only fundamental component of entered voice waveforms;

each of said fixed low-pass filters is used to output waveforms of low frequency components of specified frequencies of the entered voice waveforms;

said peak detecting means is used to detect plural maximum points on one side of waveforms of said low frequency components output from said fixed low-pass filter and to output said detected plural maximum points as a peak information;

said channel selecting means is used to select a peak detecting channel every a predetermined period on a basis of a specified selection reference by using all or some of the peak informations output from said plural peak detecting channels; and a series of pitch mark information is generated for the whole voice waveforms by using the peak information output from said selected peak detecting channel.

Still another aspect of the method according to the invention is for synthesizing voices where by analyzing target voice waveforms which are recorded in advance, phoneme series information, phoneme timing information, pitch information, amplitude information are generated, and voices are synthesized according to said phoneme series information, said phoneme timing information, said pitch information, and said amplitude information, wherein said phoneme series information holds types of phonemes and their appearance order in said target voice waveforms;

said pitch information holds information related to a pitch for each specified timing of said target voice waveforms; and said amplitude information holds information related to an amplitude of each specified timing of said target voice waveforms.

Yet another aspect of the method according to the invention is for synthesizing voices, which synthesizes a specified message by combining regular messages of natural voices and synthesized messages of synthesized voices, wherein pitch mark information corresponding to said natural voices is assigned in advance;

at least at connected portion between said regular message and said synthesized message, pitch waveforms of voice waveforms used for synthesizing voices of said synthesized message are disposed according to said pitch mark information thereby to synthesize as a synthesized message voices of the same contents as those of said regular message; and both voices having same contents are superimposed with changing a mixing rate of them at said connected portion.

Still another aspect of the method according to the invention is for synthesizing voices to generate a specified message by combining a first message and a second message, wherein pitch waveforms of voice waveforms used for synthesizing said first message are disposed according to a pitch mark information corresponding to natural voices recorded in advance for each type of said first messages, thereby to generate said first message;

at least at a connected portion between said first message and said second message, voices of the same contents as those of said first message are synthesized as said second message, then said first and second messages are superimposed at said connected portion with changing in time the mixing rate of said first and second messages having the same contents.

A medium of claim 44 is storing a program used to have a computer execute all or some of steps described in any one of above inventions.

A medium of claim 45 is for storing a program used to have a computer execute all or some of steps described in any one of above inventions.

According to configurations described above, for example it is easy to extract partitioning points corresponding to pitch cycles, since local peaks are detected from sinusoidal waveforms. Furthermore, since not zero-cross points but peak positions are extracted as partitioning points, pitch marks can be assigned to positions matching almost with local peaks and glottal closures points of voice waveforms.

BRIEF DESCRIPTION OF THE INVENTION

FIG. 5(*b*) is an example of waveform of fundamental component in an embodiment.

DESCRIPTION OF THE NUMERALS

1001 . . . WAVEFORM STORAGE 1002 . . . PITCH ANALYZER 1003 . . . ADAPTIVE LOW-PASS FILTER 1004 . . . PEAK DETECTOR 1005 . . . POLARITY DETECTOR 2001-*a* to 2001-*d* . . . FIXED LOW-PASS FILTER 2002-*a* to 2002-*d* . . . PEAK DETECTOR 2003 . . . CHANNEL SELECTOR 3001 . . . WAVEFORM STORAGE 3002-*a* TO 3002-*d* . . . FIXED LOW-PASS FILTER 3003-*a* to 3003-*d* . . . PEAK DETECTOR 3004 . . . CHANNEL SELECTOR 3005 . . . ADAPTIVE LOW-PASS FILTER 3006 . . . PEAK DETECTOR 3007 . . . POLARITY DETECTOR 4001 . . . WAVFORM STORAGE 4002-*a* to 4002-*d* . . . FIXED LOW-PASS FILTER 4003-*a* to 4003-*d* . . . PEAK DETECTOR 4004 . . . CHANNEL SELECTOR 4005 . . . ADAPTIVE LOW-PASS FILTER 4006 . . . PEAK DETECTOR 4007 . . . PITCH MARK COLLATOR 4008 . . . POLARITY DETECTOR 12001 . . . PITCH MARK STORAGE 12002 . . . AMPLITUDE INFORMATION STORAGE 12003 . . . PHONEME BOUNDARY STORAGE 12004 . . . PHONEME TYPE STORAGE 12005 . . . PITCH WAVEFORM STORAGE 12006 . . . PITCH WAVEFORM OVERLAYER 12007 . . . CONTROLLER 15001 . . . REGULAR MESSAGE GENERATOR 15002 . . . SYNTHESIZED MESSAGE GENERATOR 15003 . . . MIXER 12001-1 to 12001-N . . . PITCH MARK STORAGE 12002-1 to 12002-N . . . AMPLITUDE INFORMATION STORAGE 12003-1 to 12003-N . . . PHONEME BOUNDARY STORAGE 12004-1 to 12004-N . . . PHONEME TYPE STORAGE 17007 . . . CONTROLLER 18001-*a* to *d* . . . SENSOR 18002-*a* to *d* . . . MESSAGE INFORMATION STORAGE 18003-*a* to *d* . . . COMMUNICATION LINE 18004 . . . CENTRALIZED SUPERVISOR 18005 . . . VOICE SYNTHESIZER 19001 . . . TEXT INPUT UNIT 19002 . . . TEXT PHONEME SERIES CONVERTER 19003 . . . PHONEME SERIES STORAGE 19004 . . . VOICE INPUT UNIT 19005 . . . VOICE STORAGE 19006 . . . PHONEME TIMING DETECTOR 19007 . . . PHONEME TIMING STORAGE 19008 . . . PITCH ANALYZER 19009 . . . PITCH INFORMATION STORAGE 19010 . . . AMPLITUDE ANALYZER 19011 . . . AMPLITUDE INFORMATION STORAGE 19012 . . . VOICE SYNTHESIZER

PREFERRED EMBODIMENTS OF THE INVENTION

Hereunder, a method for assigning a pitch mark by using a voice analyzing method of the present invention will be described in detail.

(First Embodiment)

Figure 1:
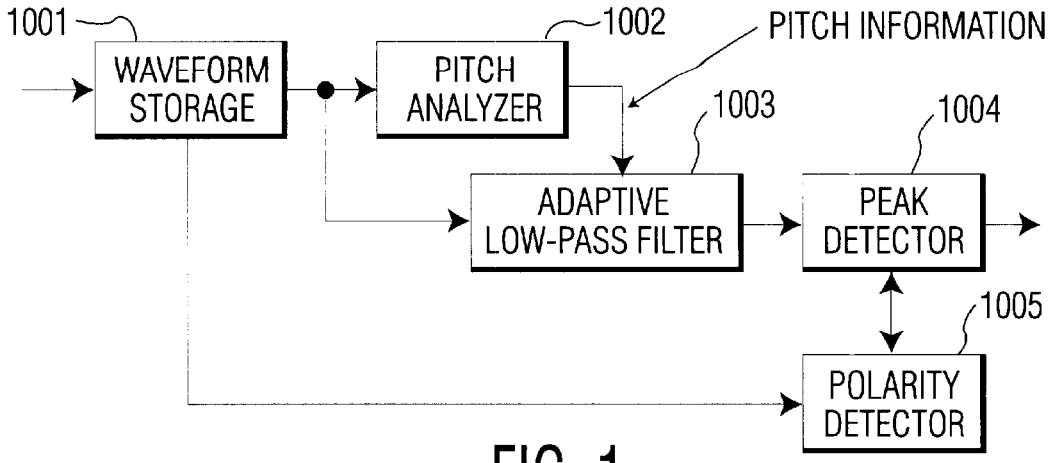
FIG. 1 is a configuration of the first embodiment for assigning pitch marks by using a voice analyzing method of the present invention.

FIG. 1 is a configuration of the first embodiment for how to assign a pitch mark by using the voice analyzing method of the present invention.

The configuration for realizing a pitch marking method in this embodiment comprises a wavef orm storage 1001; a pitch analyzer 1002; an adaptive low-pass filter 1003; and a peak detector 1004. Voice waveforms are entered to the waveform storage 1001 and the output of the waveform storage 1001 is connected to the pitch analyzer 1002 and the adaptive low-pass filter 1003 in parallel. The output of the pitch analyzer 1002 is connected to the peak detector 1004. And, the polarity detector 1005 is connected to the waveform storage 1001. The polarity detector 1005 and the peak detector 1004 are connected to each other so as to exchange information mutually.

Hereunder, a pitch marking operation of the above configuration will be described in detail.

The waveform storage 1001 stores some or all of entered voice waveforms temporarily. The pitch analyzer 1002 receives some of voice waveforms from the waveform storage 1001 and analyzes the pitch of the waveforms. A well-known pitch analyzing method can be used for this pitch analyzer 1002. For example, the pitch analyzing method may be M. J. Ross et al., "Average Magnitude Difference Function Pitch Extractors, IEEE transactions, Vol. ASSp-22, No.5, 1974.

Pitch analysis results are output to the adaptive low-pass filter 1003 as pitch information. The adaptive low-pass filter 1003 sets a cut-off frequency according to pitch information and processes voices, thereby to extract basic waves obtained by removing higher harmonic components from the voice waveforms. As the cut-off frequency, a frequency of 1.2 times the pitch frequency is used to execute this operation.

An FIR linear phase filter is suitable for the adaptive low-pass filter. This type filter has a constant delay time to any frequencies, so the output can be shifted by a fixed value, thereby to assume the actual delay to be 0.

Figure 5:
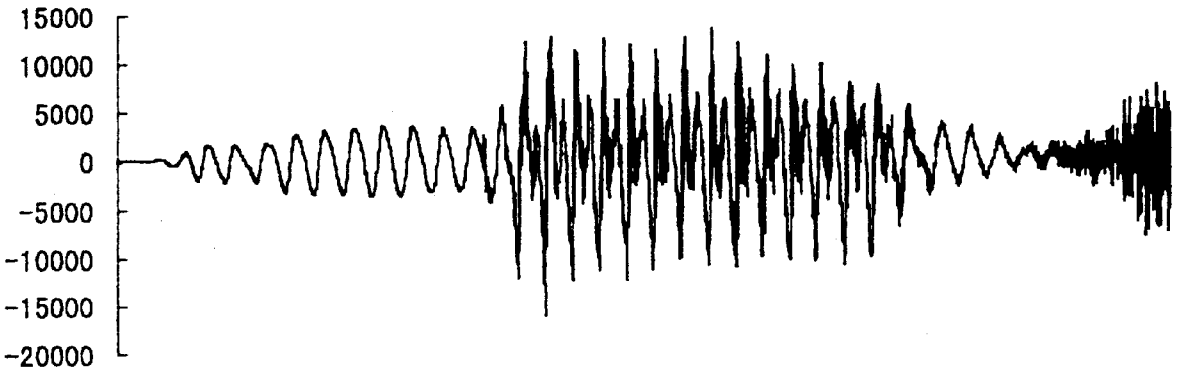
FIG. 5(*a*) is an example of voice waveforms in an embodiment.
Figure 5:
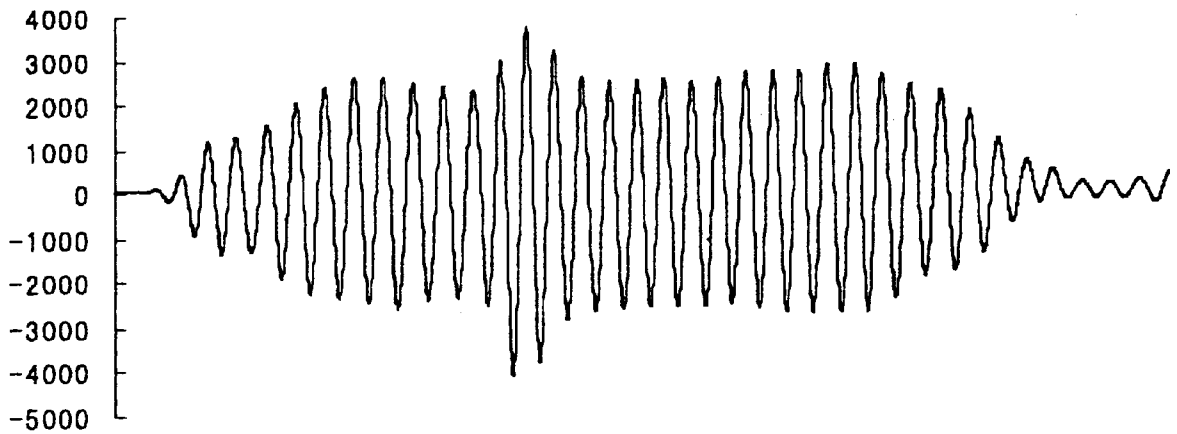

FIG. 5 shows voice waveforms and an example of fundamental component waveform obtained by processing the voice waveforms using the adaptive low-pass filter 1003. (*a*) indicates voice waveforms and (*b*) indicates fundamental component waveform. As shown in FIG. 5(*a*), voice waveforms are higher harmonic components, so the waves are complicated in form. Basic waves, as shown in FIG. 5(*b*), are simple in form like sinusoidal waves.

Figure 6:
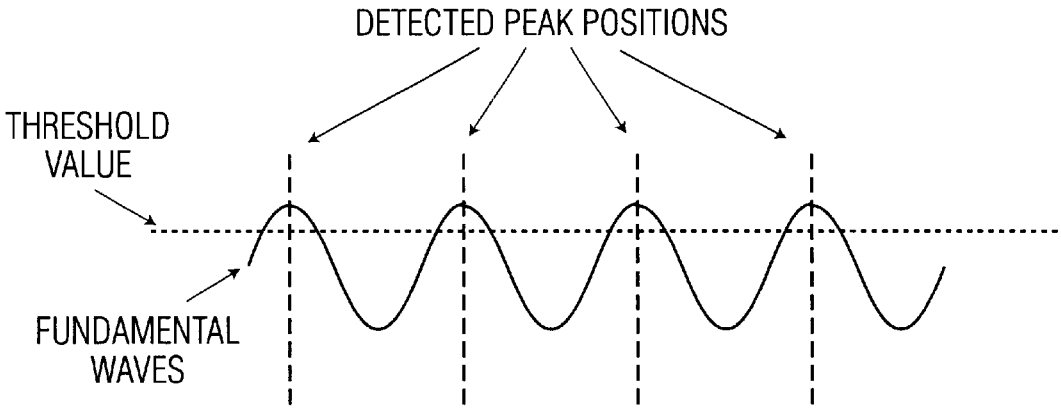
FIG. 6 illustrates an operation of a peak detector 1004 shown in FIG. 1 as an example.

Then, the peak detector 1004 detects peaks corresponding to the cycle of basic waves. Hereafter, an operation of the peak detector 1004 will be described with reference to FIG. 6. The peak detector 1003 sets a proper threshold value according to the amplitude of fundamental component waveform. Then, a peak is detected within a range over the set threshold value. Finally, the maximum point within the range is detected as a peak. Since the above peak detecting range is obtained automatically for each pitch cycle, a peak is also detected for each pitch cycle.

Figure 7:
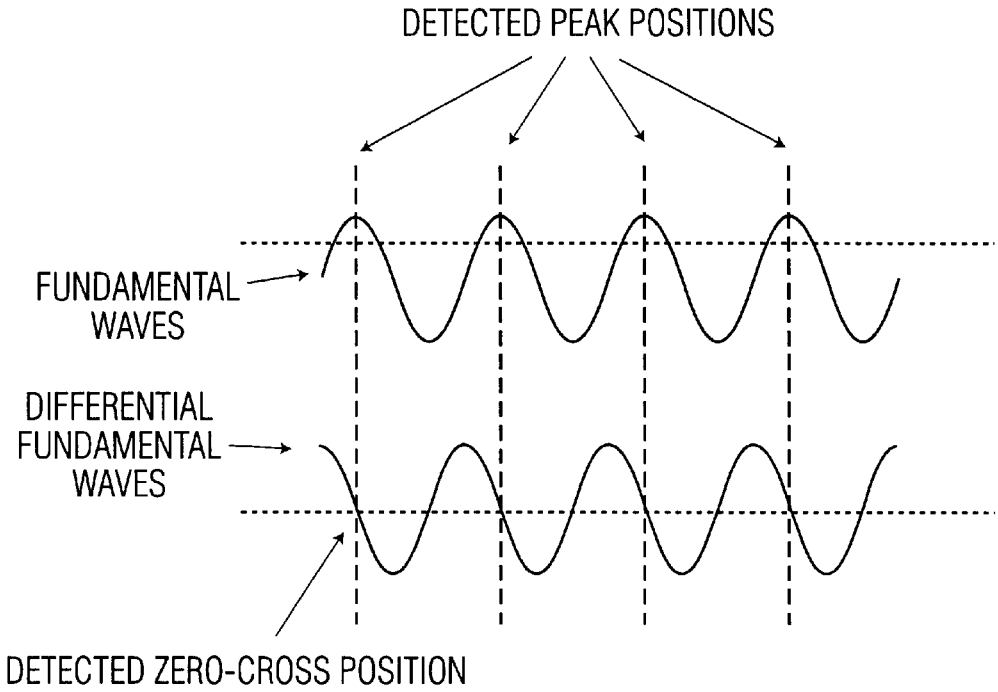
FIG. 7 illustrates another operation of the peak detector 1004 shown in FIG. 1 as an example.

There is also another method for detecting such a peak. The operation will be described with reference to FIG. 7. The waves shown in FIG. 7 are fundamental waves. The lower waves are differential fundamental waves. A differential fundamental wave is a differential from fundamental waves (the differential represents a variation amount which is obtained by subtracting from a sample value, a sample value just before the sample value). This operation is equivalent to a differentiation of analog waveforms.

Since fundamental waves are sinusoidal waves, differential fundamental waves have a phase advanced by 90 degrees than the fundamental waves. Thus peaks of fundamental waves are positioned at zero-cross points of the differential fundamental waves. When the peak detection object is a peak in a positive direction, peak is detected at a point where the value of differential fundamental waves is changed from positive to negative. Since no threshold value is set in this method, the method has an advantage of high sensibility so that peaks can be detected even from very weak fundamental waves.

Figure 8:
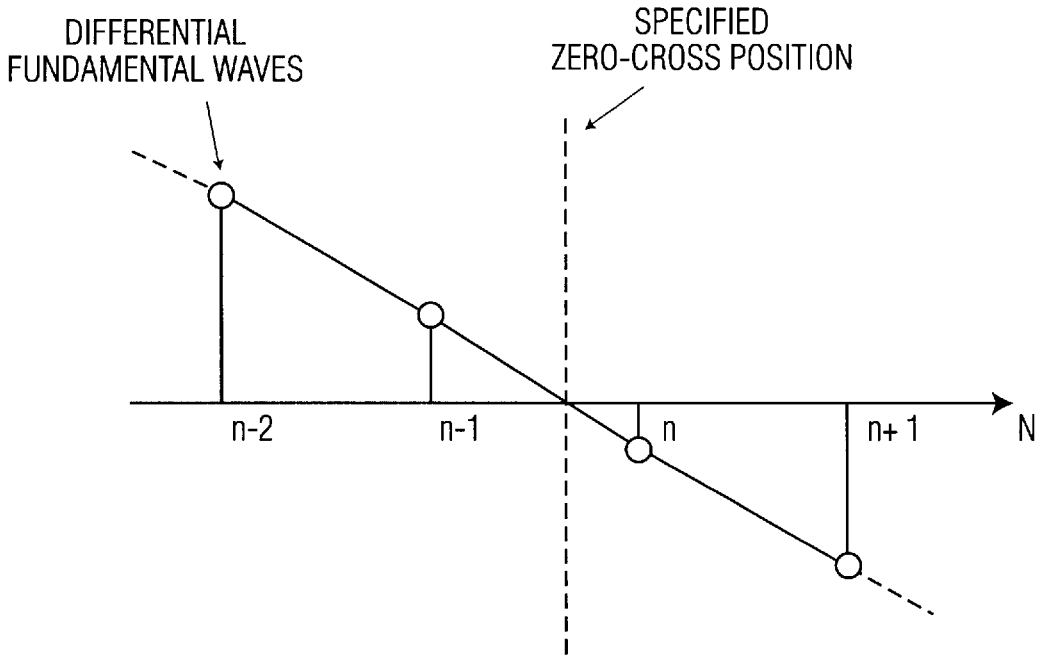
FIG. 8 illustrates an interpolation around a zero-cross point of differential fundamental waves.

Furthermore, by presuming precisely zero-cross positions of differential fundamental waves as digital data, it is possible to detect peak positions at a given accuracy defined more finely than one sample unit though conventionally, it has been possible to detect peak positions only at an accuracy of one sample unit. Since differential fundamantal waves are sinusoidal waves, waveforms around zero-cross position can be approximated by a line. As shown in FIG. 8, a highly accurate zero-cross position can be presumed by performing a linear interpolation for two data items codes of which are different and said data items are positioned at both sides of the zero-cross position of differential fundamental waves.

The zero-cross position obtained such way can be used as pitch mark information.

Figure 9:
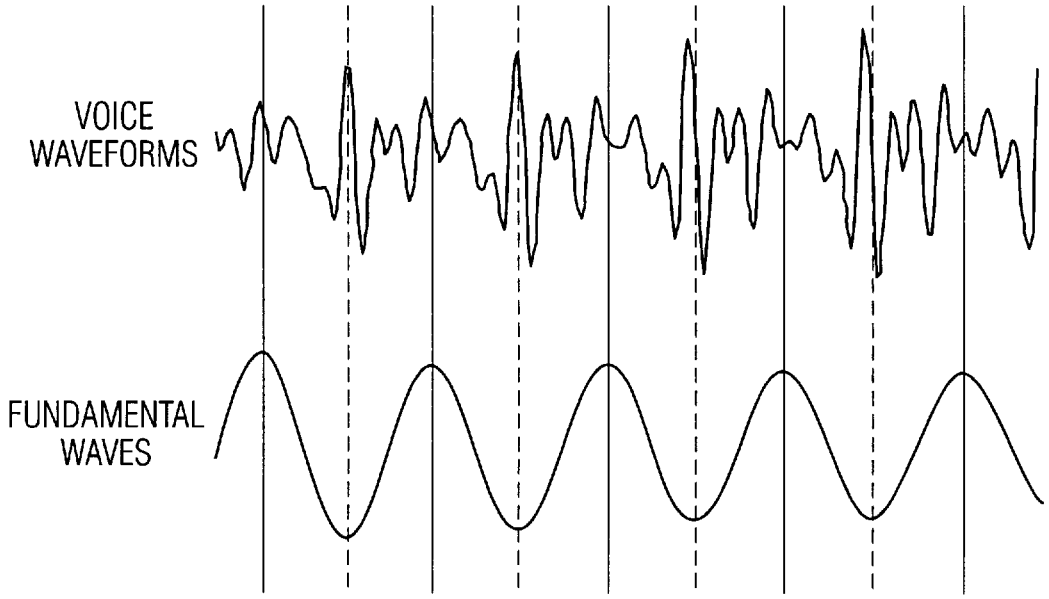
FIG. 9 illustrates a correspondence between voice waveforms and fundamental wave with respect to the time.

It is considered that there are two polarities of positive and negative for each peak to be detected. Generally, peaks having either one of those polarities can match precisely with peaks of voice waveforms. FIG. 9 indicates examples of voice waveforms and fundamental waves. In FIG. 9, a solid line indicates a positive peak of fundamental waves and a broken line indicates a negative peak of fundamental waves. Although each negative peak almost matches with a sharp change point of voice waveforms, each positive peak does not match with any of change points and peaks.

In such a case, it is considered that a negative peak of fundamental waves approximates to a glottis closing timing. Then as peak polarity, peaks of both positive and negative polarities are extracted and they are collated with voice waveforms, thereby to select one at which position value of voice waveform becomes larger as a pitch mark. It is no need to make any collation for all of the voice waveforms and a judgment for the selection is possible only for a short section. Consequently, the polarity detector 1005 receives outputs of two polarities from the peak detector 1004 for a partial section and collates them with the waveforms stored in the waveform storage 1001, thereby to decide the polarity of the whole voice. Hereafter, the peak detector 1004 keeps detection of only peaks whose polarity is decided such way.

As described above, it is considered that either polarity peak of fundamental waves approximates a glottal closure timing, and such a concept will be described more in detail below.

When voice waveforms around a certain time are represented with the (expression 1), the components of fundamental waves can be represented with the (expression 2).

[Expression 1]

$$S(n) = \sum_{k=1}^{K} a_0 \cos(k\omega_0 n + \phi_k), \qquad \text{[Expression 1]}$$

Where, K indicates the number of higher harmonic components included in the band.

$$C_0(n) = b_0 \cos(\omega_0 n + \phi_0) \qquad \text{[Expression 2]}$$

And voice waveforms can be modeled by a driving voice source g(n) and a vocal tract transmission function. The driving voice source is pulses generated by the closing operation of the glottis. The waveform g(n) can be approximated with an impulse string as shown in the (expression 3). The impulse string is characterized by that all the phases of the higher harmonic components are 0. In other words, the driving voice source waveform g(n) can be represented with the (expression 4). Consequently, the components of fundamental waves are as shown in the (expression 5). The peak positions of the components of fundamental waves match with the impulse positions of the driving voice source waveforms g(n). This means that a peak position matches with a glottal closure point.

$$g(n) = c_0 \sum_{k=-\infty}^{\infty} \delta(n - kT + p) \qquad \text{[Expression 3]}$$

-continued $$\delta(n) = \begin{cases} 1, & n = 0 \\ 0, & n \neq 0 \end{cases}$$

$$g(n) = c_0 \sum_{k=1}^{K} \cos k(\omega_0 n + \psi_0), \quad \psi_0 = 2\pi p / T \qquad \text{[Expression 4]}$$

$$g_0(n) = C_0 \cos(\omega_0 n + \phi_0) \qquad \text{[Expression 5]}$$

However, since it must be taken into consideration that the driving voice source is not impulses actually and further a delay of the vocal tract transmission function or transmission characteristics of the transmission path which is after voices are emitted from lips, must also be taken into consideration, there occurs such case where peaks of the components of fundamental waves cannot be used as pitch marks as it is. Therefore, collation with voice waveform is executed with shifting forward and backward, thereby to decide proper pitch marks. Such a method will be described more in detail with respect to a pitch marking method in the fourth embodiment of the present invention.

When the transmission characteristics of the transmission path include a significant phase distortion around the pitch frequency, for example, when the distance from lips to a microphone is long, a so-called all-pass circuit used for equalizing phases of a communication path is effective. Since the transmission characteristics for a space between lips and a microphone seems approximately high-pass characteristics, phases are advanced in low frequency bands around the pitch frequency. Then an all-pass circuit having delay characteristics around the pitch frequency is used to compensate phases, thereby to enable accurate presumption of glottal closure points.

As described above, when the pitch marking method in this embodiment is used, it is possible with a simple processing to assign pitch marks which are time reference positions corresponding to pitch cycle. Furthermore, when in detection of peaks of the components of fundamental waves, highly fine pitch mark information can be generated by linear interpolation of zero-cross position of differential fundamental waves. Consequently, the pitch marking method in this embodiment can also be regarded as a highly fine pitch analyzing method.

In this embodiment, a pitch analyzer 1002 is used and the analyzer 1002 is expected to make preparatory pitch analysis accurately to a certain extent. If an error is included in the pitch information output from the pitch analyzer 1002, the adaptive low-pass filter 1003 cuts off fundamental waves or passes higher harmonic components sometimes. Such error in pitch analysis should be avoided as much as possible.

Taking such the problems in consideration, plural sets can be used each set of which has a basic configuration of a low-pass filter and a peak detector, thereby to omit the preparatory pitch analysis described above. Such a method will be described below.

(Second Embodiment)

Figure 2:
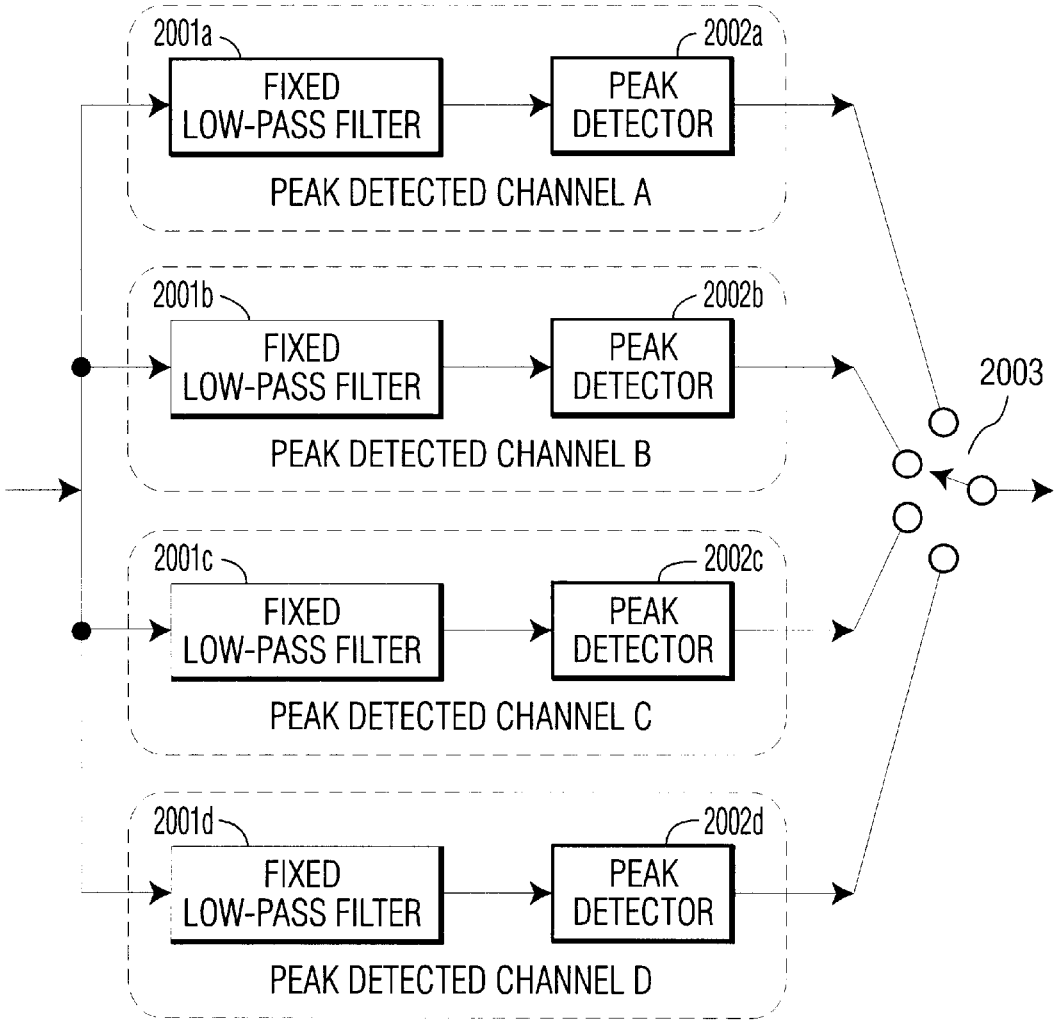
FIG. 2 is a configuration of the second embodiment for assigning pitch marks using the voice analyzing method of the present invention.

FIG. 2 is a configuration of the second embodiment for a pitch marking method of the present invention.

A configuration for the pitch marking method in this second embodiment comprises fixed low-pass filters 2001-*a* to *d*; peak detectors 2002-*a* to *d*; and a channel selector 2003. Inputs are connected to the fixed low-pass filters 2001-*a* to *d* in parallel. As such manner that the output of the fixed low-pass filter 2001-*a* is connected to the peak detector 2002-*a* and the output of the fixed low-pass filter 2001-*b* is connected to the peak detector 2002-*b*, they are connected one to one respectively. The outputs of the peak detectors 2002-*a* to *d* are connected to the plural inputs of the channel selector 2003.

A fixed low-pass filter 2001 and a peak detector 2002 make a pair and the pair is referred to as a peak detection channel or a channel simply. A channel composed of a fixed low-pass filter 2002-*a* and a peak detector 2002-*a* is referred to as a peak detection channel A or a channel A simply. Other pairs are also referred to as peak detection channels B, C, and D.

Hereunder, the configuration composed as described above for pitch marking will be described more in detail.

The fixed low-pass filters 2001-*a* to *d* receive voice waveforms commonly. The cut-off frequencies of the fixed low-pass filters 2001-*a* to *d* are fixed to 71 Hz, 141 Hz, 283 Hz, and 566 Hz respectively. By composing the low-pass filters such way, one of the four fixed low-pass filters 2001-*a* to *d* always passes only fundamental component. This condition is satisfied as long as the pitch of input voices is within 36 Hz to 566 Hz.

If the cut-off frequency of a channel is higher than the actual pitch, the peak detector 2002 detects many peaks with shorter intervals than those of the pitch cycle because the fixed low-pass filter 2001 passes higher harmonic components also at the same time. On the contrary, if the cut-off frequency of a channel is lower than the actual pitch, the fixed low-pass filter 2001 cuts off all the components including fundamental component, so that no signal is entered to the peak detector 2002 and thus no peak is detected.

The channel selector 2003 selects a channel at each unit time adaptively using such peak information indicating existence of many peaks and absence of peaks from each channel. Thus it is possible to realize a pitch marking method that needs no preparatory pitch analysis.

Hereunder, the operation principle of the channel selector 2003 will be described.

Figure 10:
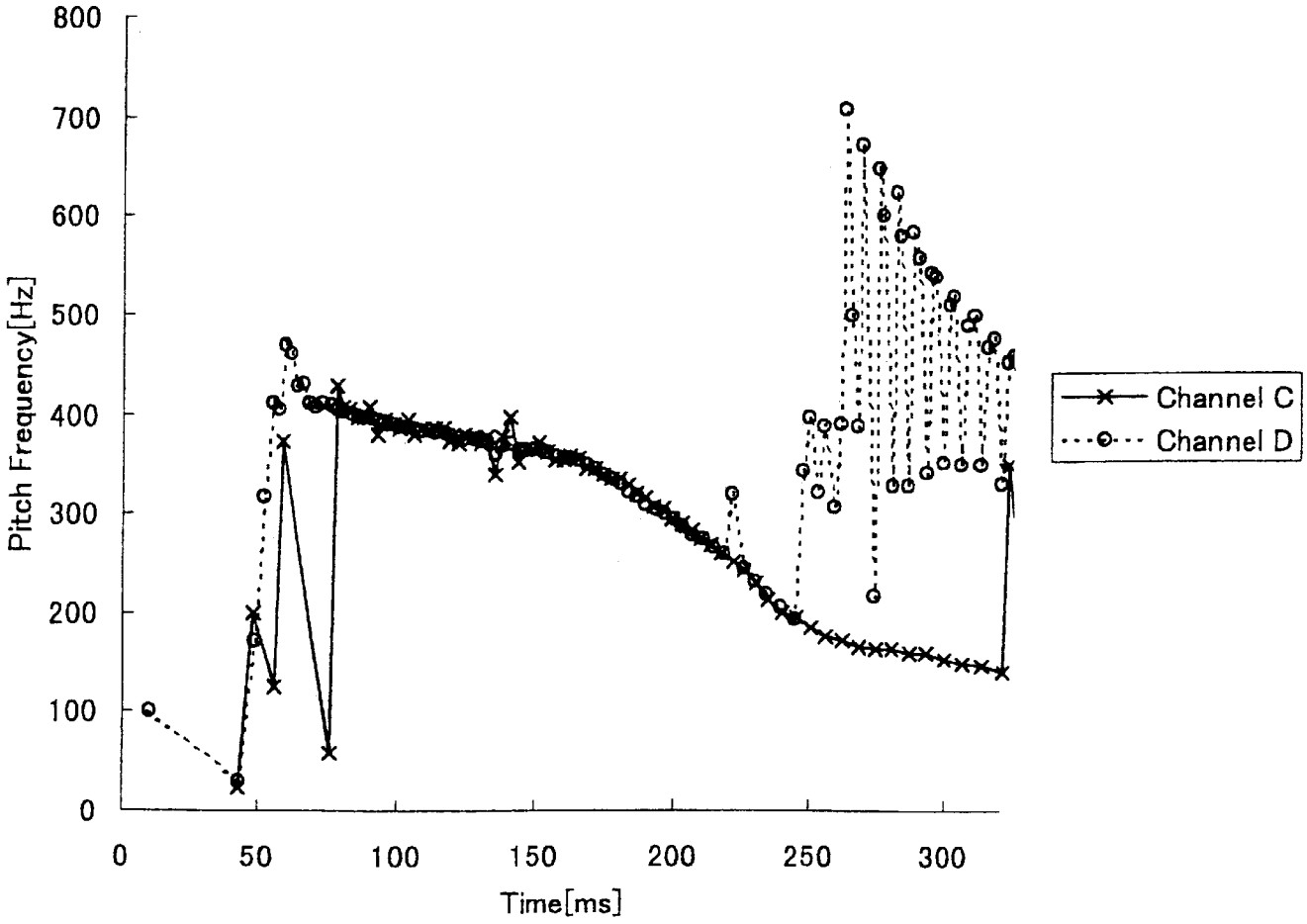
FIG. 10 illustrates outputs of a channel C and a channel D shown in FIG. 2.

FIG. 10 indicates the outputs of a voice channel C (cut-off frequency: 283 Hz) and a channel D (cut-off frequency: 566 Hz). The abscissa axis indicates peak positions (unit: milliseconds) output from the peak detector 2002-*b* and the ordinate axis indicates 1/Tp (unit: Hz) when the time interval between peaks is assumed to be Tp (unit: seconds). If this peak information is assumed to be temporary pitch mark information, the ordinate axis can be regarded to indicate a temporary pitch frequency. This voice data has a voiced portion in a section within 60 milliseconds to 39 milliseconds. In the Figure the temporary pitch frequency of the channel D is falling in the section within 60 milliseconds to 230 milliseconds. Over 230 milliseconds, however, the temporary pitch frequency rises sharply and thereafter, the frequency goes up/down significantly. On the other hand, the temporary pitch frequency of the channel C goes down gradually even in such a section.

The reason is that the true pitch frequency of the voice goes under 230 Hz after 230 milliseconds, so the output of the fixed low-pass filter 2001-*d* of the channel D includes higher harmonic components, not fundamental waves, and thereby the output includes plural peaks within one pitch cycle. Furthermore, the plural peaks within one pitch cycle do not appear at even intervals, but they are varied very complicatedly on account of the phases and the amplitudes of the higher harmonic components.

The output of a channel including higher harmonic components can be judged such way by detecting a sharp change of the temporary pitch frequency obtained from temporary pitch marks.

The channel selector 2003 can thus compare two temporary pitch frequencies positioned before and after each unit time, thereby to select a channel having the minimum change rate A(n) represented by the (expression 6).

$$A(n) = \frac{1/\{p(n+2) - p(n+1)\} - 1/\{p(n+1) - p(n)\}}{p(n+1) - p(n)} \qquad \text{[Expression 6]}$$

In the (expression 6), p(n) represents a pitch mark positioned just before a certain time, and p(n+1) and p(n+2) represent the pitch marks positioned just after and at the second position from the certain time.

There are various formats of selection algorithm for more accurate judgment. For example, as shown in the (expression 7), it will be effective that the variance V(n) of A(n), A(n−1), and A(n+1) is calculated, and a channel that minimizes the result is selected. This effect is realized by using characteristics that the temporary pitch frequency of a channel including higher harmonic components is not changed gradually, but goes up/down repetitively.

$$V(n) = \left\{\sum_{k=-1}^{1} p^2(n+k)\right\} \Big/ 3 - \left\{\sum_{k=-1}^{1} p(n+k)/3\right\}^2 \qquad \text{[Expression 7]}$$

Figure 11:
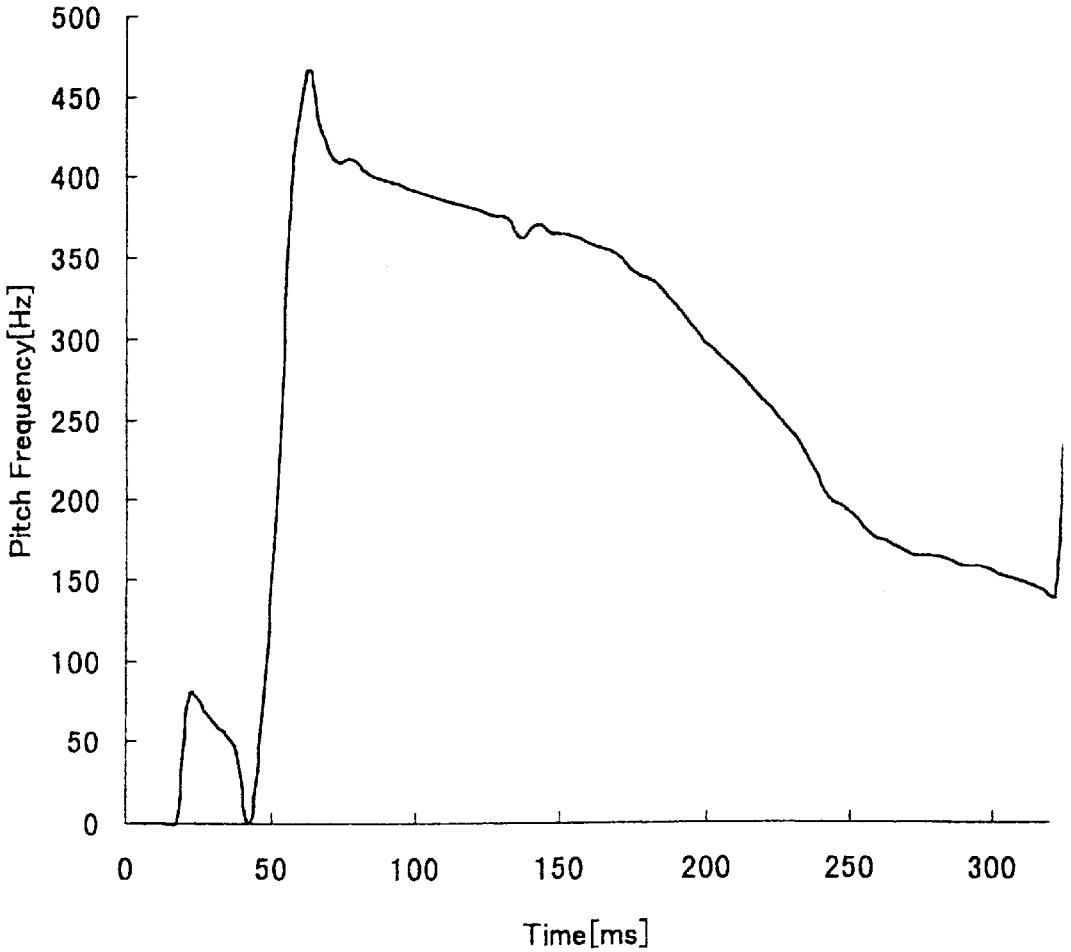
FIG. 11 illustrates a pitch frequency selected by a channel selector 2003 shown in FIG. 1.

Thus the channel selector 2003 selects channels sequentially, and thereby it is possible to extract a smooth curve as shown in FIG. 11. In FIG. 11, the abscissa axis indicates the time (unit: milliseconds) and the ordinate axis indicates pitch frequencies (unit: Hz) calculated from the pitch mark information of channels selected sequentially.

Although only four channels are used to simplify the explanation in this embodiment, the number of channels can be varied. For example, when it is found that an input voice is very low, a low frequency channel should preferably be selected. Instead, high frequency channels are omissible in cases. And, although the relation of each cut-off frequency between channels is set at double intervals sequentially, the frequency may be set at narrower intervals. Consequently, plural channels always pass only fundamental component, and thereby if they are adjacent channels the reliability is high to make the reliability of the channel selection higher.

As described above, when the pitch marking method in this embodiment is used, it is possible to obtain a proper pitch marking method without preliminary pitch analysis.

Since the pitch marking method in this second embodiment sews pitch mark informations from different channels into one pitch mark information, a slight irregularity might be generated at each junction of the pitch mark informations.

Then a series of pitch mark informations can be renewed accurately by converting pitch mark information once to pitch information, then by controlling the adaptive low-pass filter while the pitch marking method in this second embodiment is considered to be a kind of pitch analyzing method. Hereunder, an embodiment for such an operation will be described.

(Third Embodiment)

Figure 3:
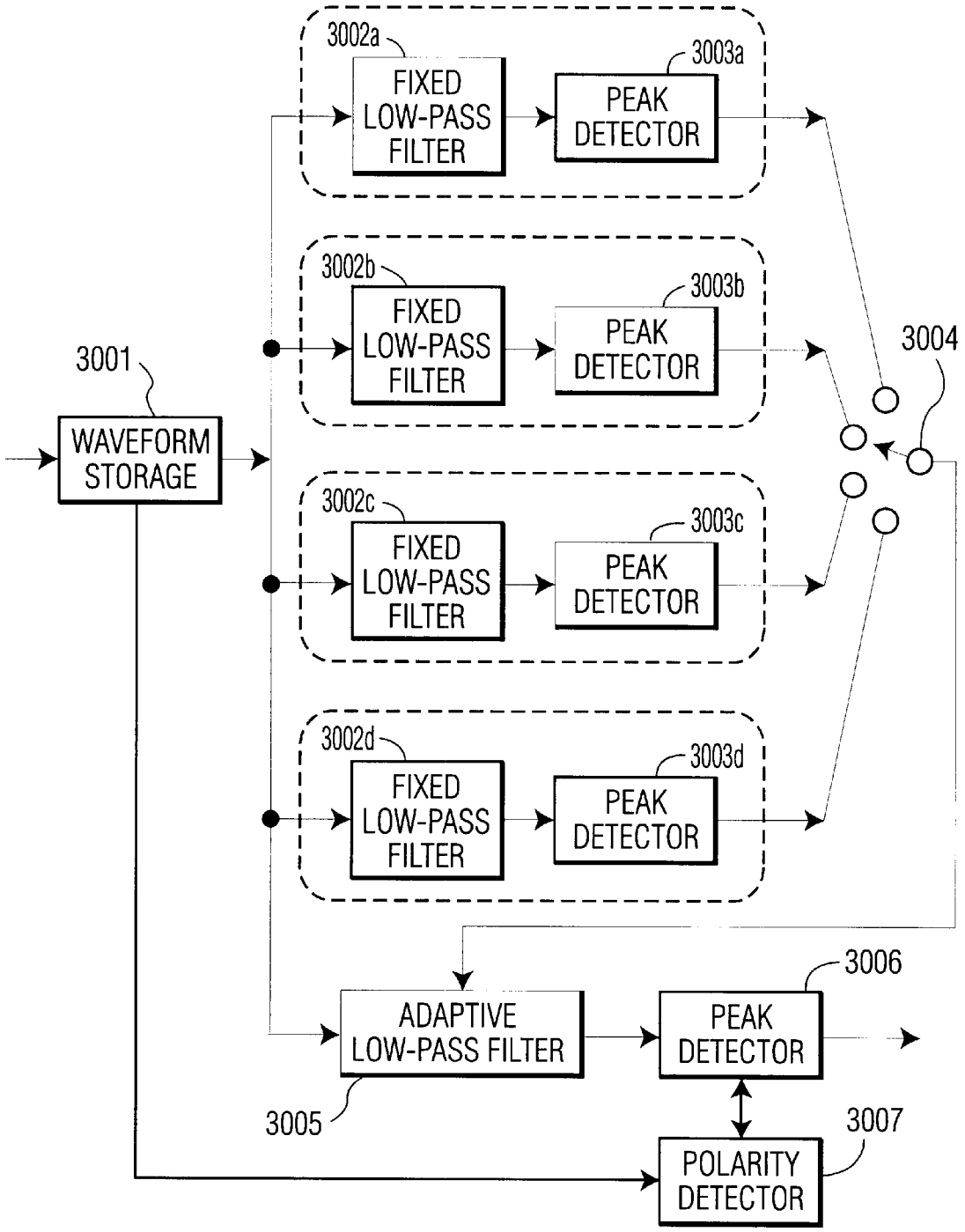
FIG. 3 is a configuration of the third embodiment for assigning pitch marks using the voice analyzing method of the present invention.

FIG. 3 is a configuration of a pitch marking method in the third embodiment of the present invention.

The configuration for the pitch marking method in this third embodiment comprises fixed low-pass filters 3002-*a* to *d*; peak detectors 3003-*a* to *d*; a channel selector 3004; an adaptive low-pass filter 3005; a peak detector 3006; and a polarity detector 3007. This configuration is such that the pitch analyzer 1002 in the first embodiment is replaced with the fixed low-pass filters 3002-*a* to *d*, the peak detectors 3003-*a* to *d*, and the channel selector 3004. In other words, the second embodiment of the present invention is used as a pitch analyzer in this third embodiment.

According to this configuration, the pitch marking method that needs no preparatory pitch analysis is assumed as a kind of pitch analyzing method and the pitch information obtained from the pitch analysis can be used for pitch marking.

(Fourth Embodiment)

Figure 4:
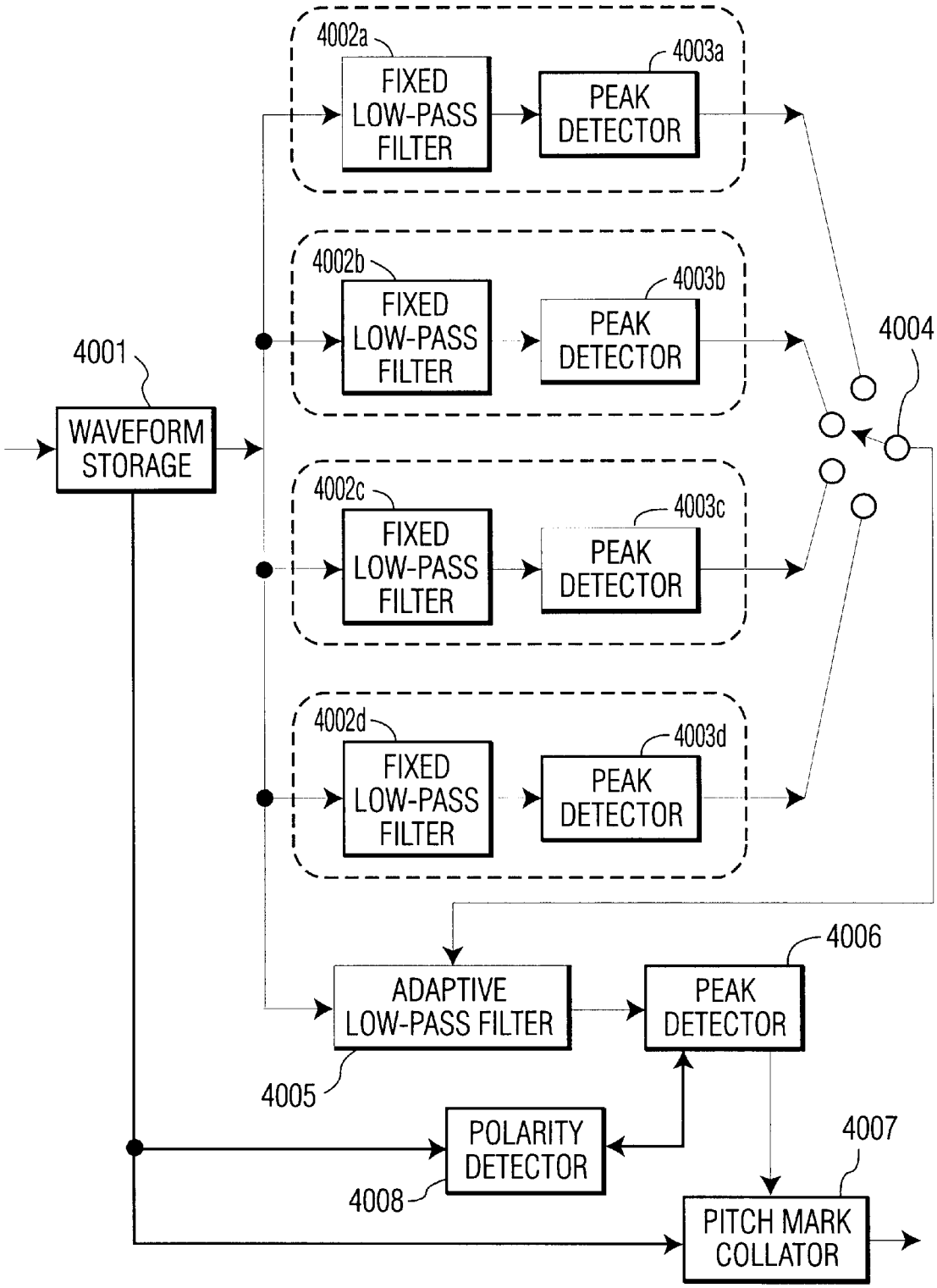
FIG. 4 is a configuration of the fourth embodiment for assigning pitch marks using the voice analyzing method of the present invention.

FIG. 4 is a configuration for a pitch marking method in the fourth embodiment for the voice analyzing method of the present invention.

The configuration for the pitch marking method in this embodiment comprises fixed low-pass filters 4002-*a* to *d*; peak detectors 4003-*a* to *d*; a channel selector 4004; an adaptive low-pass filter 4005; a peak detector 4006; a pitch mark collator 4007; and a polarity detector 4008. This configuration is such that in the third embodiment a pitch mark collator 4007 is added.

The pitch mark collator 4007 shifts peak position information output from the peak detector 4006 according to several types of values, thereby to create plural pitch mark candidates. For example, when peak information extracted by the peak detector 4006 is represented as a series as shown in the (expression 8), pitch mark candidates (expression 9) are created as shown below.

$$P(m) \qquad \text{[Expression 8]}$$

Where, P(m) represents the m-th peak position as the number of samples.

$$P'(m,k)=P(m)+k \qquad \text{[Expression 9]}$$

k: an integer

Next, pitch mark candidates created as shown in the (expression 9) are collated with waveforms, and pitch marks are selected from the candidates according to the result, and then they are output.

The collation is performed as shown below. If waveforms are represented as shown in the (expression 10), an evaluation value is calculated by using the (expression 11). Then, k that maximizes the (expression 11) is found and a pitch mark candidate P'(m,k) corresponding to the k is selected as a pitch mark.

$$S(n), \qquad \text{[Expression 10]}$$

Where, S(n) is a sample value in the time n.

$$h(k) = \sum_{m=0}^{M-1} S(P'(m, k)), \qquad \text{[Expression 11]}$$

Where, M is the number of peaks.

In other words the of such processings in the pitch mark collator 1005(sic), means such that while shifting the detected peak forward and backward with respect to the time, the position where the matching degree is highest with peak of phoneme waveform is searched. The searching range should be selected appropriately according to the delay time of the adaptive low-pass filter 4005 and a proper range will be within one pitch cycle before and after the delay time.

If the delay value of the adaptive low-pass filter 4005 is small, the output of the peak detector 406 may be used as pitch marks with no change.

The advantages of using the pitch marking method described in the first to fourth embodiments will be summarized as follows.

The first advantage is that it is possible to compose the pitch marking method simply by using an existing algorithm. That is since configuration elements of the pitch analyzer, low-pass filter, etc. are already established, it is expected that their operations are stable. In addition, when the second to fourth embodiments for the pitch marking method used for the voice analysis of the present invention are used, a preparatory pitch extracting itself in the first stage can be omitted. Or the pitch marking method used for the voice analysis of the present invention can be used, thereby to realize the preparatory pitch extracting itself.

The second advantage is that each pitch mark can be assigned accurately corresponding to a pitch cycle. When an attempt is made to extract peaks from waveforms themselves, it is impossible sometimes to extract peaks corresponding to pitch cycles due to influences of higher harmonic waves. According to the present invention, however, such a problem is avoided, since peaks are extracted only from waveforms of the components of fundamental waves. Furthermore, the judgment of voiced or non-voiced is executed only for such parts where an amplitude of waveform of the components of fundamental wave has a certain amplitude and thereby it is executed automatically. The peak detecting method that uses zero-cross points of differential fundamental waves can detect peaks of fundamental waves at a high sensibility. Consequently, peaks can be detected accurately even from faint waveforms such as portions where a vowel is started or ended.

The third advantage is that synthesized smooth voices without roughness can be obtained. For example, assume that pitch marks can be assigned at peaks on waveforms. However, since peaks on waveforms include various fluctuations caused by influences of higher harmonious waves, pitch mark positions also include complicated fluctuations. And, when voices are synthesized, positions of pitch waveforms are decided with reference to pitch mark positions and then when pitch mark positions are fluctuated forward and backward such way, synthesized voices include jitters significantly and the voices thus become rough. To avoid this, therefore, pitch mark intervals must be smoothed. Furthermore, even when pitch marks are assigned accurately at glottal closure points, the glottal closure points themselves may be fluctuated. When voices are synthesized, pitch waveforms are usually disposed on the basis of pitch mark positions and then when voices are synthesized, pitch waveforms are re-disposed at intervals different from the initial ones. Such process adds fluctuation to higher harmonic wave components which are not affected by instantaneous fluctuations and thereby this may cause synthesized voices to be indistict. The pitch marking method used for the voice analysis method of the present invention extracts peaks from the components of fundamental waves close to pure tones, so pitch marks can be assigned properly corresponding to original gradual changes of pitches. As the result smooth voices with no roughness can be synthesized while adding proper fluctuation to the synthesized voices.

Furthermore, since zero-cross points of differential fundamental waves are presumed by linear interpolation from samples positioned before and after, smooth variation of peak intervals can be obtained while not affected by the roughness of sample points. As the result extremely smooth voice quality can be realized.

In this invention, waveforms of the components of fundamental waves which are similar to sinusoidal waves are extracted by using an FIR linear phase type low-pass filter set so that only fundamental components are passed, and local peaks of the waveforms of the components of fundamental waves are marked and the marked positions are assumed as pitch marks as described above.

According to this method, therefore, since local peaks are detected from sinusoidal waveforms, it is easy to extract a partitioning point corresponding to each pitch cycle. Furthermore, since peak positions (not zero-cross points) are extracted as partitioning points, pitch marks can be assigned to positions almost matching with local peaks and glottal closure points of voice waveforms.

(Fifth Embodiment)

Next, this embodiment for a voice synthesizing method of the present invention will be described.

Figure 12:
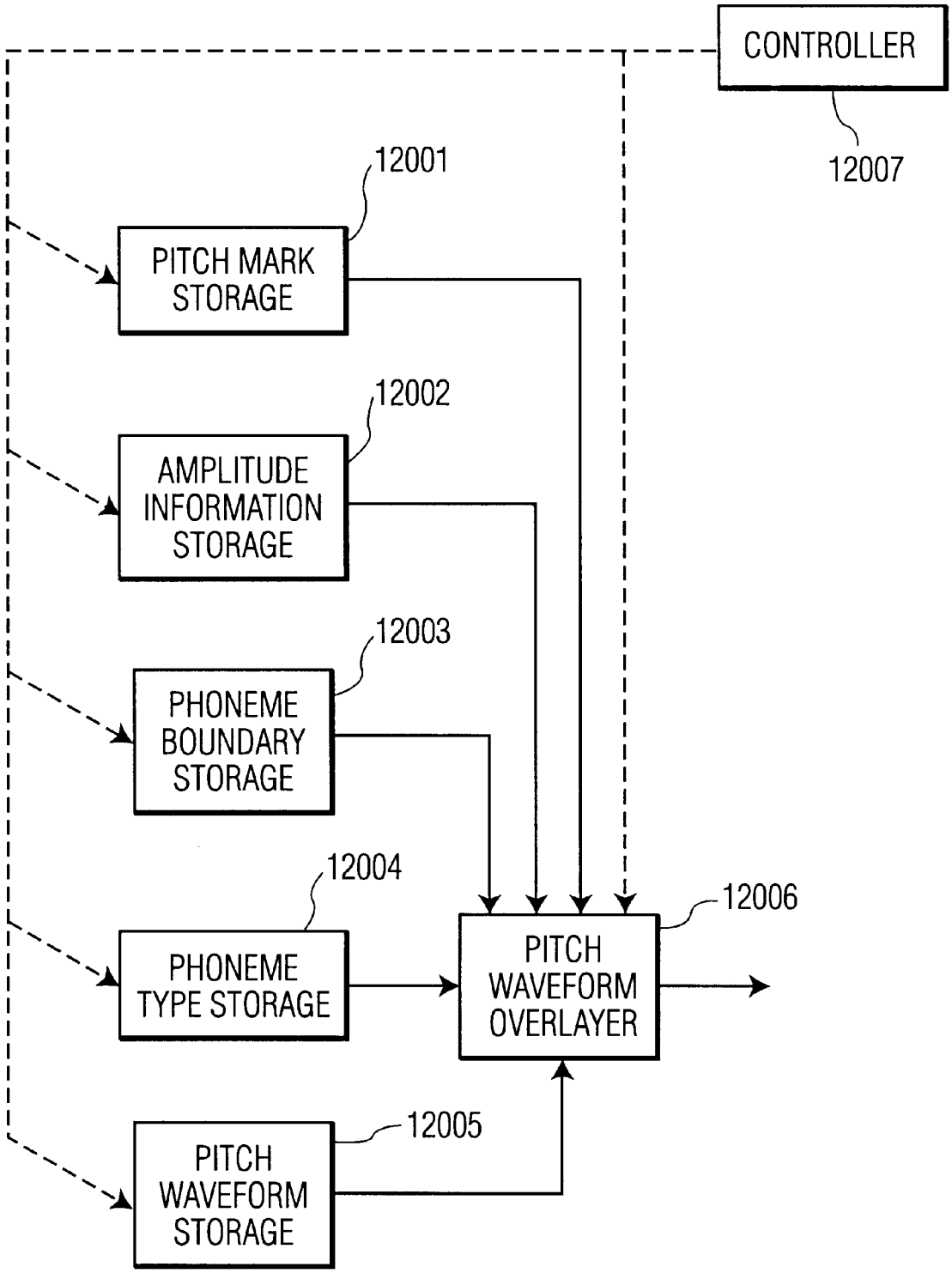
FIG. 12 is a configuration in an embodiment for a voice synthesizing method of the present invention.

FIG. 12 indicates the first embodiment for the voice synthesizing method of the present invention.

The voice synthesizing method in this embodiment of the present invention uses a pitch mark storage 12001; an amplitude information storage 12002; a phoneme boundary storage 12003; a phoneme type storage 12004; a pitch waveform storage 12005; a pitch waveform superimposer 12006; and a controller 12007 that controls all of the members described above.

The outputs of the pitch mark storage 12001, the amplitude information storage 12002, the phoneme boundary storage 12003, the phoneme type storage 12004, and the pitch waveform storage 12005 are all connected to the pitch waveform superimposer 12006.

The pitch mark storage 12001 stores pitch mark information assigned to natural voices emitted and recorded in advance. The amplitude information storage 12002 stores information indicating an amplitude around each pitch mark of natural voices and the information has such relationship of 1:1 to the pitch mark information. The phoneme boundary storage 12003 stores the timing of each phoneme boundary in the above natural voices. For example, when natural voices are "ありがとう (arigatou)", the start timings of "あ (a)", "り (ri)", "が (ga)", "と (to)", and "う (u)" are stored respectively in this storage. The phoneme type storage 12004 stores the type of each phoneme in the natural voices. For example, the storage stores information for identifying each of 5 phonemes of "あ (a)", "り (ri)", "が (ga)", "と (to)", and "う (u)". The pitch waveform storage 12005 stores many pitch waveforms cut out from voice element waveforms with each pitch mark as the center. The voice element waveforms are recorded as elements for voice synthesizing.

It is possible to use the pitch marking method of the present invention described in the first to fourth embodiments to assign pitch marks in this case. In addition, it is also possible to use any known technologies to create pitch waveforms in the pitch waveform storage 12005 and to synthesize voices by disposing pitch waveforms,the synthesizing being described later in an operation description. For example, such a technology is disclosed in Unexamined Published Japanese Patent Application No.7-152396.

The amplitude information storage 12002 stores the maximum of absolute value of amplitude of a waveform, for example, within 10 ms before and after a pitch mark of natural voices, to each pitch mark.

Figure 13:
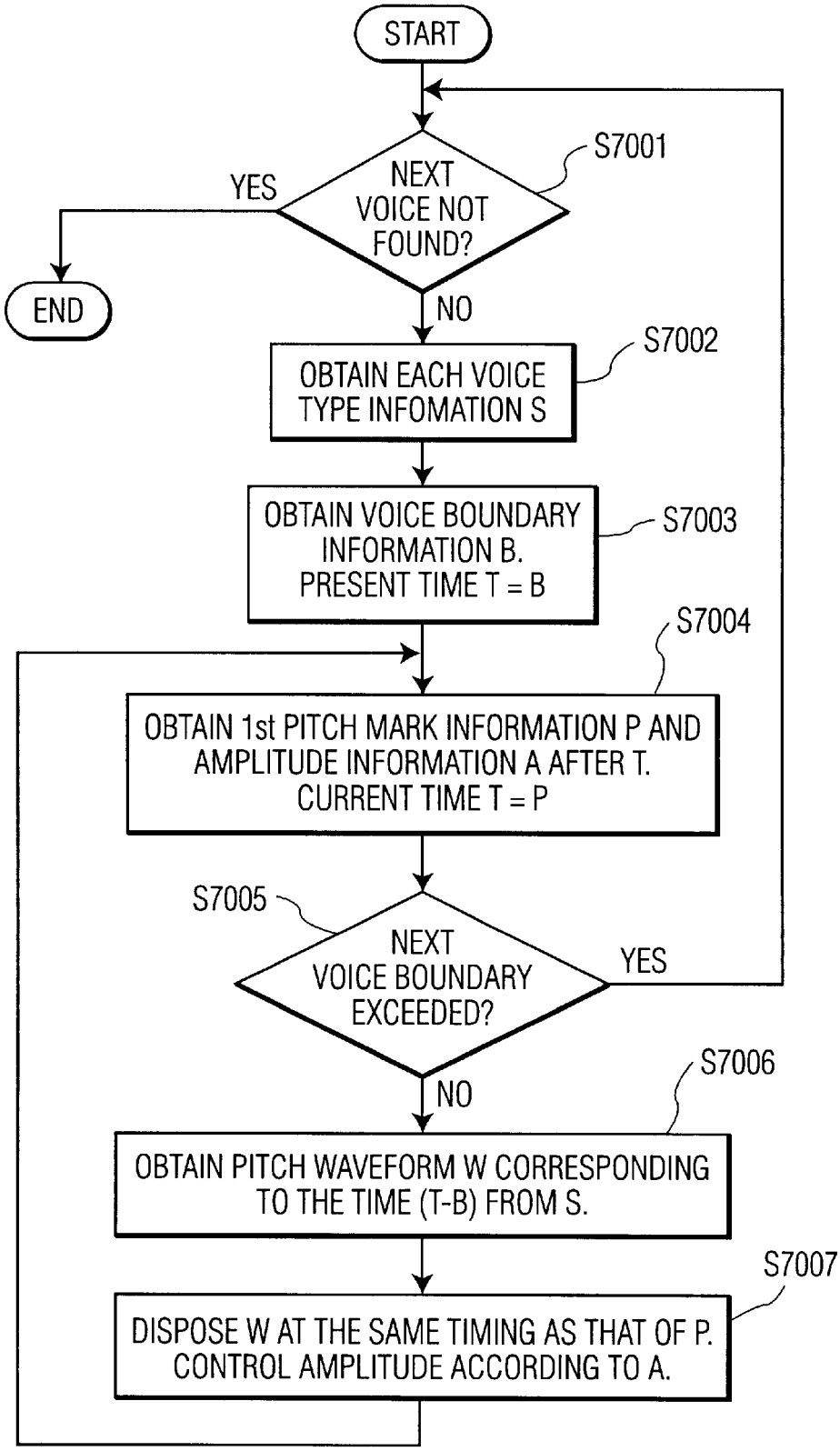
FIG. 13 is a flow chart for an operation in the twelfth embodiment.

Hereunder, explanation will be made for an operation for synthesizing voices with the same contents of those of natural voices under those conditions with reference to FIG. 13.

The controller 12007 obtains the first phoneme type information S from the phoneme type storage 12004 (S7002), then obtains the first phoneme boundary information B from the phoneme boundary storage 12003 (S7003). Such way, the controller can know the first phoneme type S and the start timing. After this, the controller 12007 obtains the latest pitch mark information P coming after the information B from the pitch mark storage 12001, as well as obtains the amplitude information A corresponding to the pitch mark from the amplitude information storage 12002 (S7004). Then, the controller 12007 obtains pitch waveforms necessary for the start portion of the information S from the pitch waveform storage 12005 (S7006) and disposes the pitch waveforms in the pitch waveform superimposer 12006 so that the timing of the pitch waveforms matches with that of the information P and controls amplitudes according to the information A (S7007) such way.

After this, the controller 12007 obtains the next pitch mark information P from the pitch mark storage 12001 and the amplitude information A corresponding to the pitch mark from the amplitude information storage 12002 (S7004). The controller 12007 also obtains the pitch waveforms corresponding to the time (T-B) of the information S from the pitch waveform storage 12005, then disposes the pitch waveforms in the pitch waveform superimposer 12006 so that the timing of the pitch waveform matches with that of the information P. The controller controls amplitudes according to the information A (S7007) such way. Hereafter, processings from 57004 to S7007 are repeated. If the obtained pitch mark information P exceeds the next phoneme boundary just after S7004, control goes to S7002 (S7005). If the next phoneme is not found just before S7002, it means the end of the message. Thus, the processing is ended (S7001).

The controller 12007 controls amplitudes in S7007 as follows. Assume now that the value of the amplitude information A is "a". This is the maximum absolute value of the amplitude, for example, within 10 ms before and after a natural voice waveform corresponding to the pitch mark information P. On the other hand, if the maximum absolute value of the amplitude of the pitch waveforms W is "aw", a gain g to be given to the pitch waveforms is calculated with the (expression 12) as follows.

$$g=a/aw \qquad \text{[Expression 12]}$$

This gain value g is multiplied by the sample placed before the pitch waveform W, thereby to control amplitudes.

Since the pitch waveform storage 12006 stores the pitch waveforms selected out from voice element dedicated waveforms in advance, pitch marks are also used to select out those pitch waveforms. As described in the first embodiment for the pitch marking method for use with the voice analyzing method of the present invention, when each a pitch mark is obtained from a zero-cross point of differential fundamental waves, linear interpolation allows pitch marks to be obtained in a more fine unit than that of one sample. By making good use of this, pitch waveforms are cut out in a more fine unit than one sample in advance, thereby to get more smooth waveforms synthesized in the pitch waveform superimposer 12006.

Figure 14:
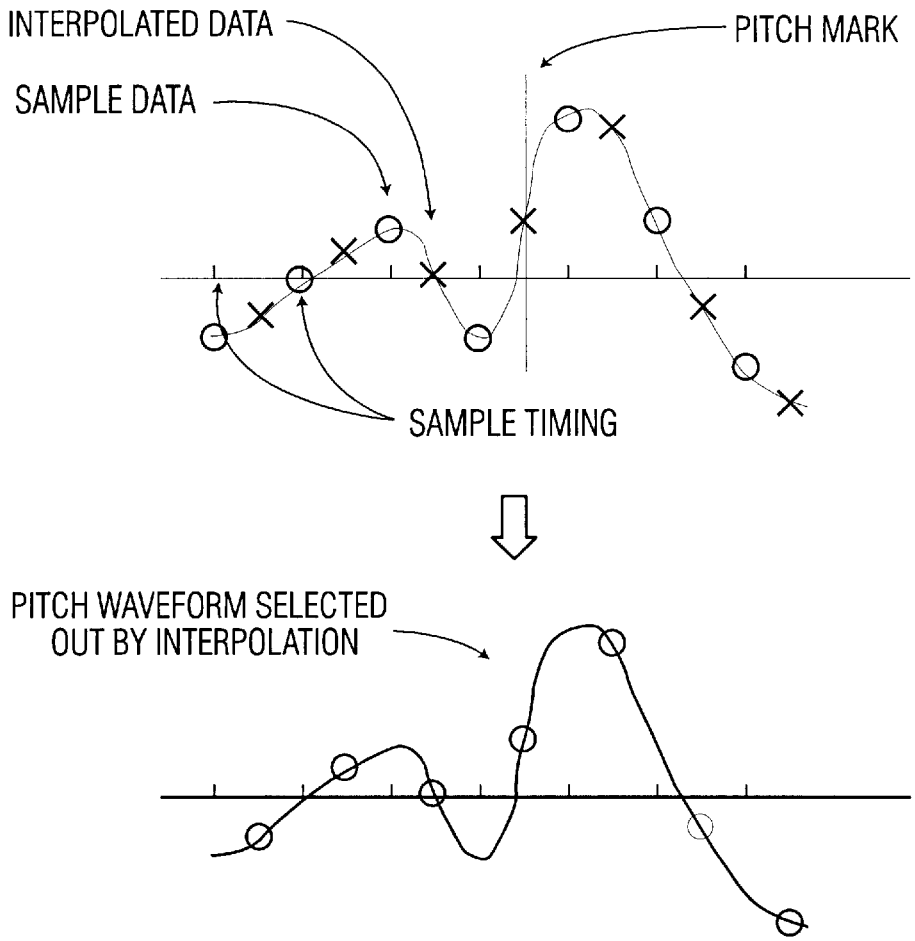
FIG. 14 illustrates how pitch waves are selected out during an interpolation.

FIG. 14 indicates a method for cutting out pitch waveforms. In both upper and lower drawings, the abscissa axis indicates the time and the ordinate axis indicates amplitudes of waveforms. The scale divisions of the abscissa axis indicate sample timings. Values in digital data are defined only with sample timings. In the upper drawing, each circle (○) indicates voice waveform sample data recorded as digital data. The curve indicates analog voice waveforms. The vertical line indicates a pitch mark position.

When a pitch mark is not an integer, the pitch mark does not match with a sample timing as shown in the drawing. Then the closest sample timing and other two sample timings before and after the closest one (three in total) are used for secondary interpolation, thereby to presume data at each pitch mark position. In the same way every data is presumed at such positions (are shifted by a fixed amount from the sample timings) which are at an integer multiple of sample intervals before and after from the pitch mark. A presumed value is represented by x. The lower drawing indicates only presumed extracted data.

Every presumed value is cut out and stored as a waveform such way. In addition to the secondary interpolation, any interpolation methods such as linear interpolation, spline interpolation, etc. are usable.

When pitch mark information stored in the pitch mark storage 12001 is not an integer, the timing for disposing waveforms in the pitch waveform superimposer 12006 is not an integer. Thus, voices with smooth changes of pitches are synthesized by performing interpolation in the same concept as that for cuting out pitch waveforms.

Voices synthesized such way have the same timings, pitch patterns, and amplitude changes as those of natural voices from which pitch marks are generated and further match with timings and phases of waveforms as those of natural voices almost completely. It is thus possible to obtain very natural synthesized voices including so-called micro-prosody information in which pitches go up/down finely at each consonant and before and after the consonant.

In this embodiment, although information of a pitch pattern and an amplitude is held for each pitch mark, an average value of each specified section may be used. Consequently, it is possible to compress information of pitch patterns and amplitudes and prevent the quality of synthesized voices from degradation. For example, if a section between starting points of a phoneme is partitioned into a specified number of sections, regardless of the voicing speed efficient information corresponding to the number of phonemes regardless of the speed of voices, can be held. In addition, such a method for holding information has an advantage that a very high quality of voices can be held even when the speed of synthesized voices is changed freely by changing the start timing information of phonemes. Furthermore, both pitch information and amplitude information can be changed. And, by changing phoneme series information, it is also possible to change the contents of the voice. But the phoneme which can be changed should be such phoneme that one before the changing and one after the changing have similar characteristics. For example, the voice quality is comparatively less degraded between voiced sounds or between voiceless sounds, and then those sounds can be replaced with each other.

Although no unit of information is defined for phoneme type information S in the above description, phonemes should preferably used. A phoneme is a unit for presenting each consonant or each vowel. For example, the voice of "かゝ (ka)" is composed of two phonemes of /k/ and /a/.

Although only a case that uses amplitude information is described above, it is also possible to synthesize voices with amplitudes of phonemes as are without using the amplitude information. In such a case, the quality of voices will not be natural slightly, but timings and pitch patterns are those of natural voices and thus, a feeling of naturalness in the voices is still high.

Although the maximum absolute value around each pitch mark is used in the above embodiment, any other values may be used, of course, when amplitude information is used. The amplitude of voice waveform is not distributed in uniform in both directions and it is generally one-sided to a certain polarity. This is because pulses which is generated when the glottis is closed, are in one direction. Using the maximum value of such the one-sided amplitude in response to this pulse direction is effective to prevent influences on fluctuation and noise included in voice waveforms. In addition, it will also be possible to use power within a short time around each pitch mark.

Furthermore, it will also be possible to remove high components of natural voices by using a low-pass filter before amplitude information is extracted. This method is effective to remove the fluctuation of amplitude information which is caused when the amplitude of natural voices is changed finely by high components.

Since the quality of synthesized voices is decided by pitch waveforms stored in the pitch waveform storage 12005, pitch marks, amplitude information, phoneme boundary information, and phoneme type information will be satisfactory even when they are extracted from comparatively low quality voices. For example, if the pitch waveform band width is 10 kHz, the band width of synthesized voices is also 10 kHz. Consequently, if pitch marks, amplitude information, phoneme boundary information, and phoneme type information are extracted from voices in a band width of 5 kHz, it is possible to synthesize a voice in a wider band than that of those voices. Since this enables voices which becomes in narrower bands through a telephone line, to be converted to high quality voices, it is very useful.

(Sixth Embodiment)

Next, another embodiment for synthesizing voices using a method of the present invention will be described.

There is a method for providing voice messages by combining recorded voices with synthesized voices. Such a method is suitable for such messages, each of which is composed of regular portions and irregular portions. The regular portions mentioned here are common in many of various messages. The irregular portions mentioned here are portions, each including many patterns such as objects, place names, etc.

In such a method for providing messages, regular portions are provided as recorded voices and irregular portions are provided as synthesized voices. For example, assume that there are a message of "次は (tsugiwa)京都 (Kyoto) に (ni) 止まります (tomarimasu)" and a message of "次は (tsugiwa) 熱海 (Atami) に (ni) 止まります (tomarimasu)". In these two messages, there is only a difference of "Kyoto" and "Atami" and portions of "tsugiwa" and "ni tomarimasu" may be common. In this case, "tsugiwa" and "ni tomarimasu" are regular portions and "Kyoto" and "Atami" are irregular portions, since place names, station names, etc. are considered limitlessly for these irregular portions. Then regular portions are recorded as natural voices in advance, since their types are less and irregular portions are generated as synthesized voices. However, since the quality of synthesized voices is worse than that of recorded voices, a quality change appears significantly at each connected portion to make listeners feel something wrong.

To avoid such poor feeling, therefore, regular and irregular messages are connected by changing the mixing ratio between recorded and synthesized voices so that a regular message is replaced with synthesized voices gradually. This method is disclosed, for example, in Unexamined Published Japanese Patent Application No.5-27789, etc. The prior art synthesizing method, however, arises a problem that voices are heard as double voices since pitches and phases are changed there at superimposed portions on the regular message.

In this embodiment of the present invention, therefore, the method for synthesizing voices in the first embodiment is used for the voice synthesizer. Consequently, pitches and phases are completely matched between recorded voices and synthesized voices, thereby to obtain an excellent method for connecting voices so that both recorded and synthesized voices, even when they are superimposed, can be heard just like single type voices.

Figure 15:
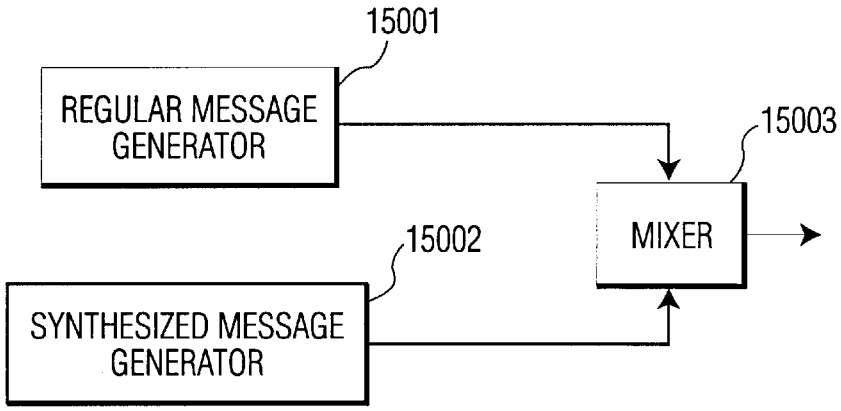
FIG. 15 is a configuration of another embodiment for the voice synthesizing method of the present invention.

FIG. 15 indicates a configuration of such a voice synthesizing method. This method uses a regular message generator 15001; a synthesized message generator 15002; and a message mixer 15003. The regular message generator 15003 stores waveforms of regular portions of messages and those waveforms are read as needed, thereby to output part of an object message. The synthesized message generator 15002 is composed as shown in FIG. 12. Each of the pitch mark storage 12001, the amplitude information storage 12002, the phoneme boundary storage 12003, and the phoneme type storage 12004 stores such the information taken out from the waveforms stored in the regular message generator 15001.

Hereunder, an operation of the method for synthesizing voices shown in FIG. 15 will be described using a message of "tsugiwa Kyoto ni tomarimasu" shown above as an example.

In order to simplify description, it is assumed that both regular message generator 15001 and synthesized message generator 15002 generate the same message "tsugiwa Kyoto ni tomarimasu".

Figure 16:
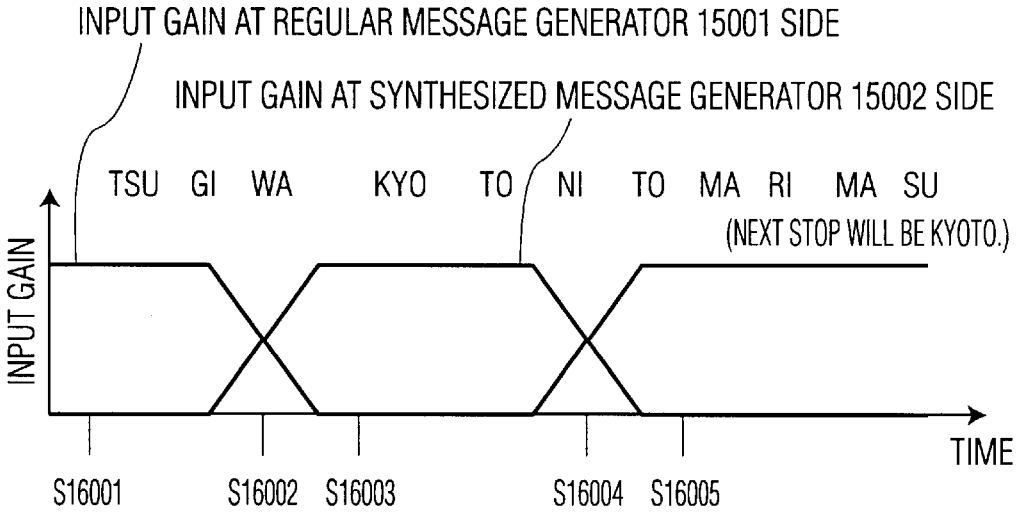
FIG. 16 illustrates a change of gains at two input terminals of a mixer 15003 shown in FIG. 15.

FIG. 16 indicates a change of the gain at two input terminals of the message mixer 15003. At first, at a start of a message the regular message generator 15001 starts reading of a regular portion "tsugiwa" and outputting of the message to the message mixer 15003. The start of a message mentioned here means the header of a voiced message, that is, the portion of the timing of "tsu" shown in FIG. 16.

At this time, the message mixer 15003 maximizes the input gain at the regular message generator 15001 and clears the input gain at the synthesized message generator 15002 to zero (S16001).

On the other hand, the synthesized message generator 15002 starts synthesizing of a message portion "tsugiwa" concurrently with the regular message generator 15001. At this time, pitch mark information, phoneme boundary information, and phoneme type information are all taken out from waveforms of the regular message portion as described above, the synthesized voice waveforms have the same pitch and phase as those of the regular message.

When the output of the message reaches latter half of the message "tsugiwa", the message mixer 15003 decreases the input gain at the regular message generator 15001 gradually and increases the input gain at the synthesized message generator 15002 gradually (S16002). Consequently, waveforms of both recorded and synthesized messages are superimposed at the latter half of "tsugiwa".

The message mixer 15003 decreases the input gain at the regular message generator 15001 to 0 and maximizes the input gain at the synthesized message generator 15002 before the message output reaches "Kyoto" (S16003). Consequently, the portion "Kyoto" is output only as synthesized voices.

When the message output reaches "tomarimasu", the message mixer 15003 increases the input gain at the regular message generator 15001 gradually and decreases the input gain at the synthesized message generator 15002 gradually (S16004). Then, the message mixer 15003 maximizes the input gain at the regular message generator 15001 and clears the input gain at the synthesized message generator 15002 to 0 (S16005).

As a result of the processings described above, the regular portions of the message are output as recorded voices and the irregular portions of the message are output as synthesized voices. At each connected portion (junction) of both messages, an operation is executed so that the mixing ratio between those regular and irregular portions is changed gradually. Thus, recorded and synthesized voices are replaced there smoothly. And, the portion "Kyoto", which is an irregular message, can be replaced with another word (for example, "Atami"), thereby to change messages.

A pitch pattern in an irregular message portion may be generated using regular message pitch marks, but other pitch generating methods may also be used. Especially, for a place name such as "Atami" other than "Kyoto", the pitch pattern of "Kyoto" is not always fit. So, it would be appropriate to use a pitch generating model such as "Fijisaki Model", etc.

Although both regular message generator 15001 and irregular message generator 15002 are used to generate a whole message in the above embodiment, those message generators 15001 and 15002 may also be used to generate only the minimum necessary portions of a message. For example, the regular message generator 15001 may generate only the portions of "tsugiwa" and "ni tomarimasu" and the synthesized message generator 15002 may generate only the portion of "ha Kyoto ni", then those portions are connected into one. This method will be desirable for the reasons of processing efficiency.

(Seventh Embodiment)

Next, another embodiment for the voice synthesizing method of the present invention will be described.

As described in the voice synthesizing method in the sixth embodiment, regular message portions and irregular message portions are connected, thereby to generate one message. Such a message providing method arises a problem that a difference is generated in voice quality between recorded portions and synthesized portions. In addition to the problem, it is also another problem that an apparatus used for recording messages requires a large capacity. Especially, the latter problem is serious when many types of recorded message portions are to be used.

Then in this embodiment, regular message portions are not stored as recorded voices, but stored as pitch mark information, phoneme boundary information, and phoneme type information, so that messages are generated using the first embodiment for the voice synthesizing method of the present invention.

The first and second messages of the present invention correspond to the regular and irregular messages in this embodiment.

Figure 17:
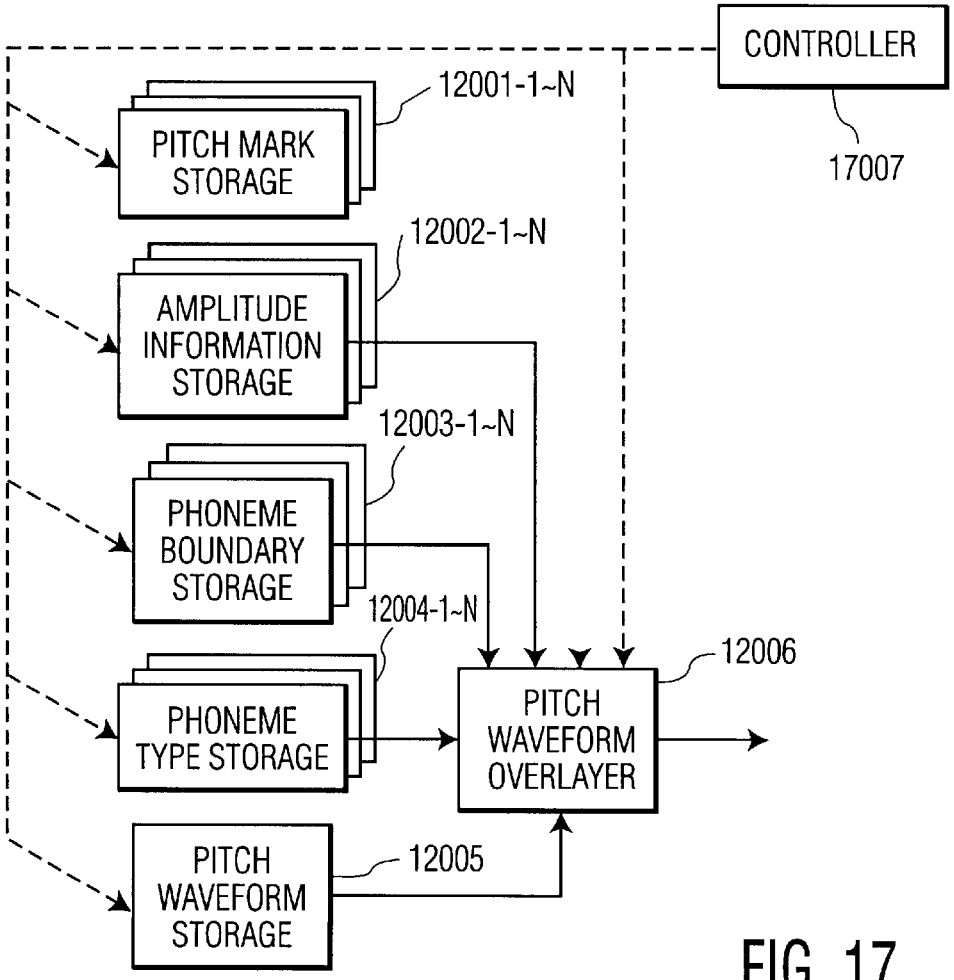
FIG. 17 is a configuration of another embodiment for the voice synthesizing method of the present invention.

FIG. 17 indicates a configuration of the voice synthesizing method in this embodiment. The configuration is composed of pitch mark storages 12001-1 to N; amplitude information storages 12002-1 to N; phoneme boundary storages 12003-1 to N; phoneme type storages 12004-1 to N; a pitch waveform storage 12005; a pitch waveform superimposer 12005; and a controller 17006. This configuration is the same as that shown in FIG. 12 except for that the pitch mark storage 12001; the amplitude information storage 12002; the phoneme boundary storage 12003; and the phoneme type storage 12004 are provided by N units respectively in this embodiment. N indicates the number of regular messages. If n is assumed to be a regular message number, the regular message information is stored in the pitch mark storage 12001-n; the amplitude information storage 12002-n; the phoneme boundary storage 12003-n; and the phoneme type storage 12004-n respectively.

When voices are to be synthesized for the k-th regular message, the controller 17007 selects the pitch mark storage 12001-k; the amplitude information storage 12002-k; the phoneme boundary storage 12003-k; and the phoneme type storage 12004-k respectively. Hereafter, voices are synthesized in the same procedure as that shown in FIG. 13. In other words, when the suffix k is omitted, voices are synthesized using the information related to the regular messages stored in the pitch mark storage 12001; the amplitude information storage 12002; the phoneme boundary storage 12003; and the phoneme type storage 12004.

Voices are synthesized for an irregular message according to a pitch pattern generated by itself in the same way as ordinary voice synthesizing.

It would be better if voices are synthesized to generate this irregular message by the same method described in the sixth embodiment. In other words, in such a case, at least at each connected portion between regular and irregular messages is disposed pitch waveforms of voice waveforms used for synthesizing voices of the irregular message, according to pitch mark information, thereby to synthesize voices of the same contents as those of the regular message as an irregular message.

The pitch mark information mentioned here is extracted from natural voices recorded in advance for each type of regular messages described above. Consequently, the feeling of something wrong caused by changes of voice quality at connected portions is reduced more effectively.

Since both regular and irregular message portions are provided as synthesized voices due to such the processings, the feeling of something wrong for voice quality caused at connected portions is reduced significantly. Furthermore, since synthesized voices generated using pitch mark information extracted from natural voices is used for regular message portions, the voices are heard much more naturally than the prior art synthesized voices.

Furthermore, the storage capacity used for regular message portions can be reduced more significantly than that of recorded message portions. Concretely, to record a message for one second, the storage capacity needed for recording the message is 11 kilobytes when a 4-bit ADPCM is used at a sampling frequency of 22.05 kHz. On the other hand, according to the message storing method in this embodiment, the number of pitch marks is 300 per second when the average pitch is 300 Hz. If each pitch mark needs 4 bytes and 4 bytes are assigned to each amplitude information, the necessary capacity is 2.4 kilobytes (300×4+300×4=2400 bytes=2.4 kilobytes). When amplitude information is omissible, the necessary capacity is 1.2 kilobytes (300×4=1200 bytes=1.2 kilobytes). When compared with pitch mark information, phoneme boundary information and phoneme type information are very small in size and they are neglectable.

According to the examination above, it is found that the storing capacity is about 1/5 of that of recorded messages. If amplitude information is omitted, the storage capacity is only about 1/10 needed to store messages. And, as described above, pitch mark information and amplitude information can further be compressed effectively if the data type is devised. For example, a voiced phoneme section is divided into 4 sub-sections and both pitch and amplitude information are assigned to each of those sub-sections, information can be compressed to about 1/100 of recorded data.

Since it is possible to obtain high quality synthesized voices from information compressed to a very small capacity, it is possible to improve the efficiency for reading the information from a recording medium and transmitting the information via a communication line significantly. Consequently, it is also possible to record the information on a medium such as a CD-ROM whose access speed is slow and transmit the information fast via a communication line whose transfer rate is low.

Making good use of such the advantages, highly efficient storing and presenting methods can be realized.

(Eighth Embodiment)

Next, an embodiment of a voice reporting system of the present invention will be described.

Figure 18:
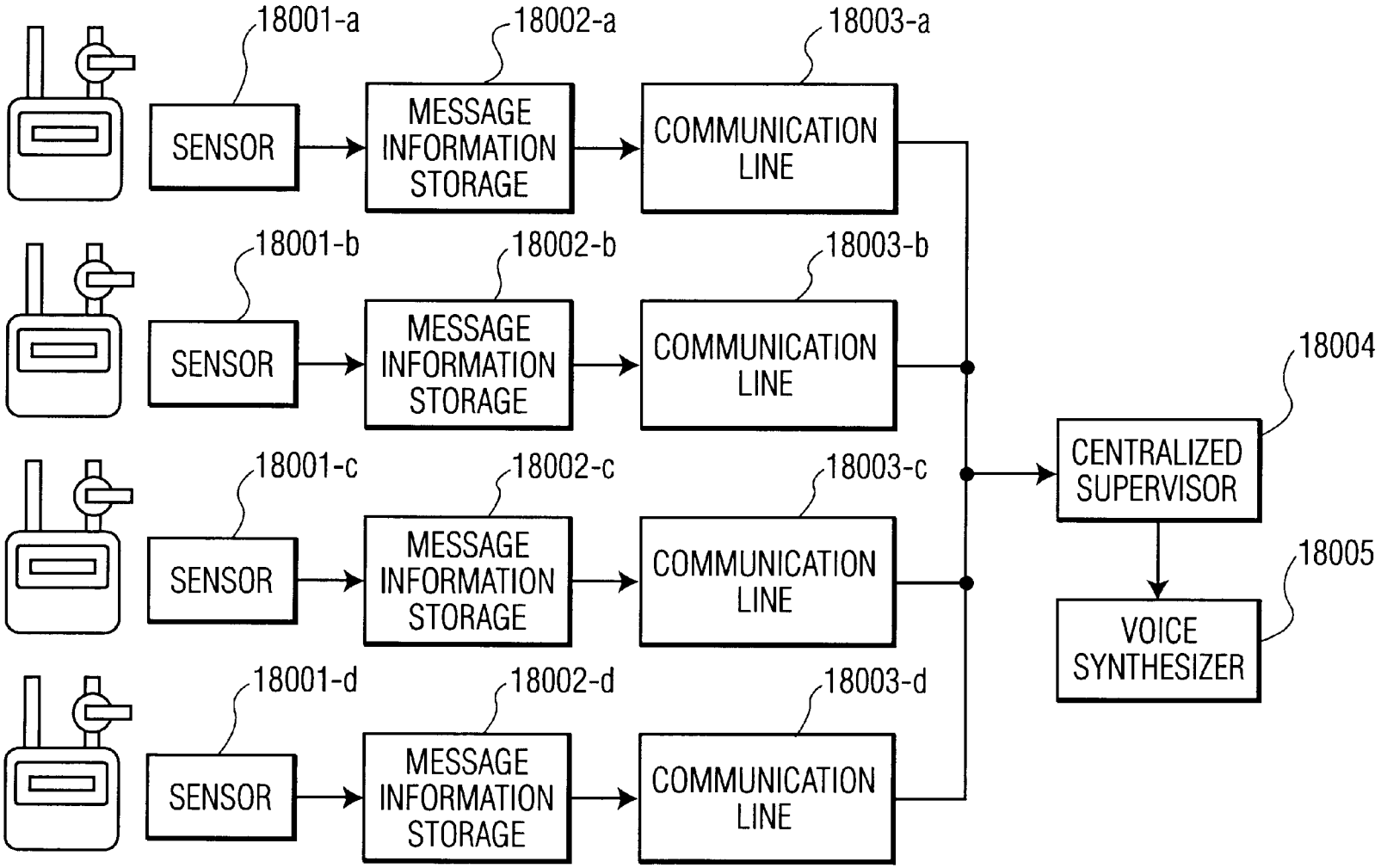
FIG. 18 is a configuration of an embodiment for a voice reporting system of the present invention.

FIG. 18 shows a configuration of the voice reporting system in this embodiment.

The voice reporting system in this embodiment is composed of plural sensors 18001; plural message information storages 18002; plural communication lines 18003; a centralized supervisor 18004; and a voice synthesizer 18005. The sensors 18001 and the message information storages 18002 are attached to, for example, each domestic gas meter. The centralized supervisor 18004 and the voice synthesizer 18005 are used, for example, in a control room of a gas company. The communication lines 18003 may be telephone lines connected between each domestic gas meter and the gas company.

Each of the message information storages 18002 stores phoneme series information, phoneme timing information, pitch information, and amplitude information of messages. Hereafter, those items will be referred as message information collectively. When any sensor 18001 senses an event such as a gas leak, the sensor 18001 instructs the message information storage 19002 to output message information. The message information is transmitted to the centralized supervisor 18004 via a communication line. The centralized supervisor 18004 uses the message information, thereby to control the voice synthesizer 18005 and output voices. The voice synthesizer 18005 uses the voice synthesizing method in above embodiments of the present invention.

The advantage of this type is that a mass of voice data can be stored in the message information storage 18002 using a small capacity. Furthermore, since less information is transmitted via the communication line 18003, the communication line needs only a small capacity even to transmit message information fast.

Consequently, the message information storage 18002 attached to each domestic gas meter can store information specific to each home, such as the name, address, etc. in addition to event information, such as a gas leak, etc. This makes it possible to report a place where an abnormality is detected to the control room of the gas company properly, so that necessary countermeasures can be taken quickly. It is also easy to modify information accompanied by a contract and cancellation of the contract for a gas supply and more than the information is registered and managed in the control room.

Although a gas meter and a gas company are picked up for the description in this embodiment, this system is usable in any other scenes, of course.

(Ninth Embodiment)

Next, an embodiment for a voice synthesizing system of the present invention will be described.

Figure 19:
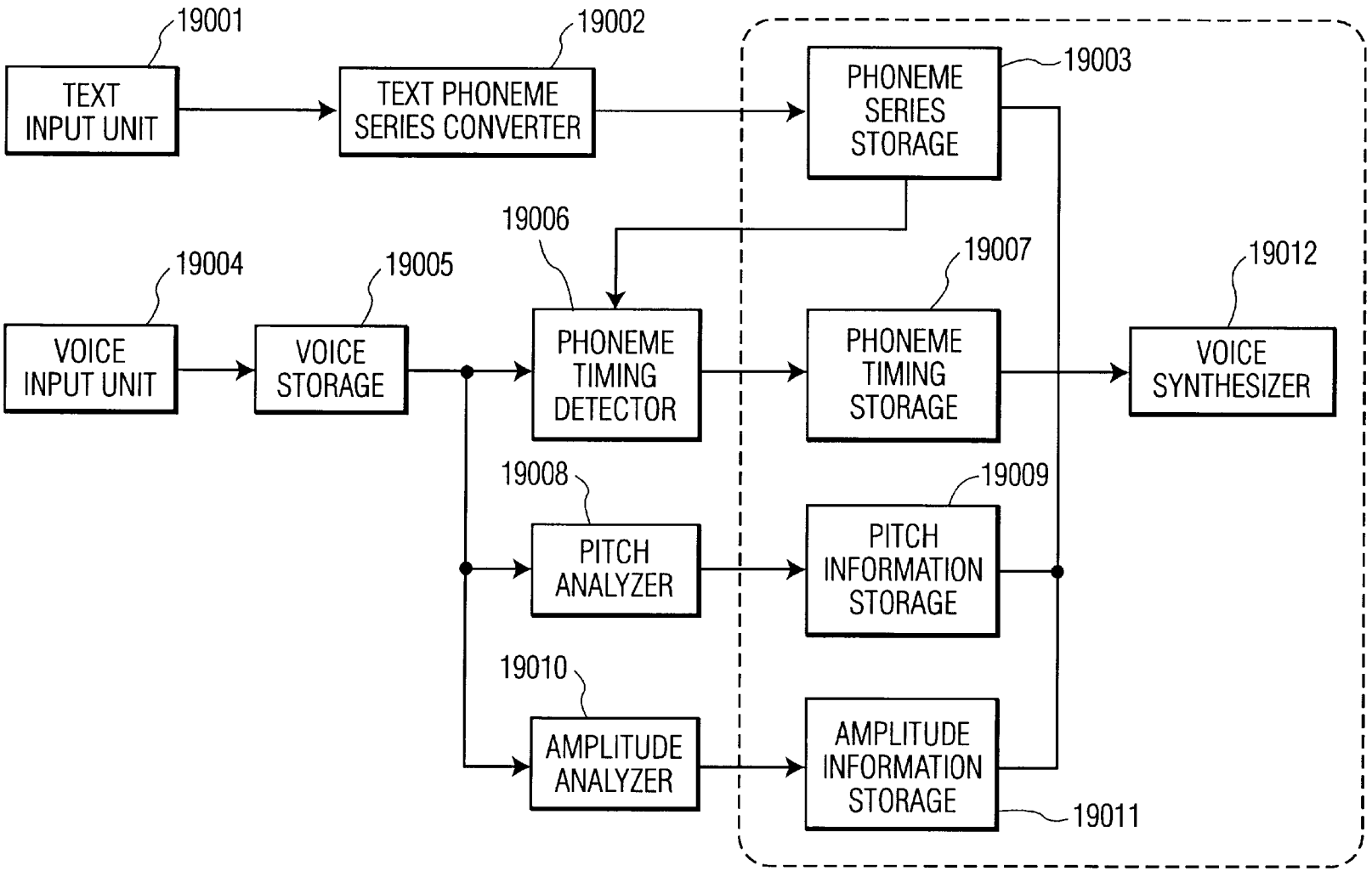
FIG. 19 is a configuration of an embodiment of the voice synthesizing system of the present invention.

FIG. 19 is a configuration of the voice synthesizing system in this embodiment.

The voice synthesizing system in this embodiment is composed of a text input unit 19001; a text phoneme series converter 19002; a phoneme series storage 19003; a voice input unit 19004; a voice storage 19005; a phoneme timing detector 19006; a phoneme timing storage 19007; a pitch analyzer 19008; a pitch information storage 19009; an amplitude analyzer 19010; an amplitude information storage 19011; and a voice synthesizer 19012.

The text input unit 19001 prompts the user to enter a text and the user enters contents to be announced as a kana (Japanese character) text in response to the prompt. The text phoneme series converter 19002 converts the entered kana text string to a phoneme series such as phonemes. The phoneme series storage 19003 stores the converted phoneme series.

After this, the voice input unit 19004 prompts the user to enter voices and the user speaks to enter the same contents as those of the text entered previously. The voice storage 19005 stores entered voices temporarily. The phoneme timing detector 19006 detects all the phoneme timings of the voices using the voices stored temporarily in the voice storage 19005 and the phoneme series stored in the phoneme series storage 19003. Such a phoneme timing detection is realized by using a voice recognition algorithm such as the HMM. The detected phoneme timing information is stored in the phoneme timing storage 19007.

The pitch analyzer 19008 can analyze pitches accurately using the pitch marking method in the above embodiments for the voice synthesizing method of the present invention. The pitch analyzer 19008 analyzes pitches of the voices stored temporarily in the voice storage 19005. The pitch information storage 19009 stores information of the analyzed pitches. The amplitude analyzer 19010 analyzes amplitudes of the voices stored temporarily in the voice storage 19005. The amplitude information storage 19011 stores information of analyzed amplitudes.

The voice synthesizer 19012 uses the voice synthesizing method described in the above embodiments of the present invention. The voice synthesizer 19012 reads phoneme series information, phoneme timing information, pitch information, and amplitude information from the phoneme series storage 19008, the phoneme timing storage 19007, the pitch information storage 19009, and the amplitude information storage 19011 respectively, then synthesizes voices using those read information.

According to the above configuration, voice messages can be used as described below. This voice synthesizing system is incorporated, for example, in a domestic electrical appliance. In this embodiment, it is assumed that the voice synthesizing system is incorporated in a full-automatic washing machine. Necessary components to be incorporated are only the phoneme series storage 19008, the phoneme timing storage 19007, the pitch information storage 19009, and the amplitude information storage 19011 (enclosed by a broken line in FIG. 19). Other components may be removed after information analysis is ended.

After clothes and a detergent are put in the full-automatic washing machine, it is only needed to press the START switch. Washing, rinsing, and spin-drying are all performed automatically. The user can thus do other works during the washing. When the spin-drying is ended, however, the user must hang wet clothes to dry. Usually, a full-automatic washing machine has a built-in buzzer, so that the end of spin-drying is notified to the user.

In recent years, however, many home-use electrical appliances have such a function commonly, so it arises a problem that the user cannot understand what the buzzer voice means.

For solving such a problem in this voice synthesizing system the user can registers beforehand by using his voice voice messages which the user wishes the washing-machine to announce. In other words, the end of spin-drying can be notified with voices as the user wishes to hear, for example, "脱水が終わりました (dassui ga owarimashita)" (in English; Dry-spinning has been ended" or "洗濯が終了しました (sentaku ga syuryoushimashita)" (in English; Washing has been ended).

This voice synthesizing system can reproduce the very contents and the intonation with which the user has spoken to register faithfully. Consequently, the intonation of what the user wants the washing machine to speak can be changed freely, so that the system is usable in a variety of fields according to the application purpose.

Many users do not like hearing his/her voice played back, since the voice is heard differently from real one. On the other hand, in this system, only the intonation is played back faithfully; the voice quality is decided by synthesis units. The user's voice is thus converted to the quality of a professional narrator s voice, for example. The user will thus feel less aversion for hearing his/her played back voices. In addition, the user will be pleased to hear voices narrated by a professional narrator as if he/she made the voice by himself/herself.

Although a home-use full-automatic washing machine is selected as an example in this embodiment, this system may be used in any scenes and for any devices, of course.

Furthermore, a medium such as magnetic or optical recording medium which stores programs which can execute by a computer the functions or operation of all or part of the means described in the above embodiments, can be produced and the medium may execute the same operation as the above.

The advantages of the pitch marking method of the present invention, therefore, are summarized as follows; 1) a well-known algorithm can be used to execute this pitch marking, 2) accurate pitch marking can be assured corresponding to each pitch cycle, and 3) it is possible to obtain smooth and no rough synthesized voices.

Furthermore, the advantages of the voice synthesizing method of the present invention are thus summarized as follows; 1) very natural synthesized voices can be obtained by reproducing natural pitch patterns included in natural voices in detail, 2) connections between recorded voices and synthesized voices can be smoothed with extremely gradual replacement of voices without a feeling of something wrong, 3) messages can be provided with the same voice quality between regular and irregular message portions, and 4) voices of regular message portions can be stored in a less capacity storage than that of the prior art recording method.

Although regular and irregular portions are combined to form messages in the above embodiments, only regular portions may be used to form messages.

As understood clearly from the above description, the present invention can analyze voices more properly using a comparatively simple method than the prior art. For example, pitch marks can be assigned more properly than the prior art.

Furthermore, the present invention has an advantage that voices can be synthesized more naturally with less feeling of something wrong even at portions connected to recorded voices than the prior art method.

What is claimed is:

1. A method for analyzing voices by generating pitch mark information as time reference positions corresponding to a pitch cycle of voice waveforms comprising the steps of:

temporarily storing a portion of the voice waveforms using voice waveform storing means;

generating rough pitch information from said voice waveforms stored temporarily by using pitch analyzing means;

inputting said voice waveforms stored temporarily to an adaptive filter and changing a cut-off frequency or a center frequency of said adaptive filter according to said rough pitch information, and passing only a fundamental component extracted from the inputted voice waveforms; and detecting plural maximum points at one side of said fundamental component using peak detecting means, and generating a series of pitch mark information for a whole portion of the voice waveforms.

2. A method for analyzing voices by generating pitch mark information as time reference positions corresponding to a pitch cycle of voice waveforms comprising the steps of:

setting cut-off frequencies of plural fixed low-pass filters so that at least one of said plural fixed low-pass filters passes only a fundamental component of input voice waveforms;

outputting from each of said fixed low-pass filters waveforms of low frequency components of the inputted voice waveforms;

detecting, by using peak detecting means, plural maximum points on one side of waveforms of said low frequency components output from said fixed low-pass filters and outputting said detected plural maximum points as peak information;

selecting, by using channel selecting means, a peak detecting channel every predetermined period on basis of a specified selection reference by using the peak information output from said plural peak detecting means; and generating a series of pitch mark information for the voice waveforms by using the selected peak information output from said selected peak detecting channel.

3. A method for analyzing voices which assigns pitch marks to said voice waveforms according to the pitch mark information obtained by using said method as defined in claim 1 or 2.

4. A method for analyzing voices which obtains a pitch frequency by using pitch mark information obtained by using said method as defined in claim 1 or 2.

5. A method for analyzing voices according to claim 4, which assumes pitch mark information as temporary pitch marks and calculates a pitch frequency by using intervals of said temporary pitch marks existing just before and just after each specified unit time.

6. A method for analyzing voices according to claim 2, wherein cut-off frequencies of said plural fixed low-pass filters take a relationship of 1:2 to each other.

7. A method for analyzing voices according to claim 2, wherein meaning of the selection of the peak detecting channel on a basis of the specified selection reference is that from a time interval between a specified peak and a peak adjacent to said specified peak, the time interval of which is obtained from the peak information output from each of said peak detecting means, a temporary pitch frequency is obtained, at the specified peak position and a peak detecting channel is selected, said selected peak detecting channel having a minimum change rate of said temporary frequency within a specified unit time.

8. A method for analyzing voices according to claim 2, wherein meaning of the selection of the peak detecting channel on a basis of the specified selection reference is that from a time interval between a specified peak and a peak adjacent to said specified peak, the time interval of which is obtained from the peak information output from each of said peak detecting means, a temporary pitch frequency is obtained, at the specified peak position and when plural peak positions included in a specified time range and said pitch frequencies corresponding to those peak positions are represented as points on a coordinate system taking peak positions on its abscissa axis and temporary frequencies on its ordinate axis, and those points are connected in an order of peak positions, thereby to form plural lines, and the peak detecting channel is selected so that a variance of an inclination of those plural lines is minimized for said selected peak detecting channel.

9. A method for analyzing voices according to claim 1 or 2, wherein the peak detecting means detects a maximum point of an amplitude in a positive or negative direction in each portion where the amplitude of waveforms of said low frequency components or said fundamental component exceeds a threshold value which is constant or changed at every specified unit time.

10. A method for analyzing voices according to claim 1 or 2, wherein the peak detecting means assumes as maximum point such a position where a value of a differential fundamental component which is differential of said fundamental component is changed from positive to negative or from negative to positive.

11. A method for analyzing voices according to claim 1 or 2, wherein said peak detecting means assumes as maximum point such a zero-cross point presumed by using linear interpolation method for values before and after a point where a value of a differential fundamental component which is differential of said fundamental component is changed from positive to negative or from negative to positive.

12. A method for analyzing voices according to claim 1, wherein said adaptive filter takes 0 as an actual delay value for every frequency.

13. A method for analyzing voices according to claim 2, wherein said fixed low-pass filter takes 0 as an actual delay value for every frequency.

14. A method for analyzing voices according to claim 1, wherein by using means for collating pitch marks, plural pitch mark information candidates are generated by shifting each pitch mark forward or backward with maintaining the interval between those pitch marks at fixed, said each pitch mark being included in said series of pitch mark information which was created before once;

a value of voice waveform at a position represented by each pitch mark included in said pitch mark information candidates is read from said voice waveform storage; and said read values are considered wholly, thereby to calculate a peak matching degree, so that a pitch mark candidate that takes the maximum peak matching degree is selected.

15. A method for analyzing voices according to claim 14, wherein said peak matching degree is a sum of said read values.

16. A method for analyzing voices according to claim 2, wherein by using means for collating pitch marks plural pitch mark information candidates are generated by shifting each pitch mark forward or backward with maintaining the interval between those pitch marks at fixed, said each pitch mark being included in said series of pitch mark information which was created before once;

a value of voice waveform at a position represented by each pitch mark included in said pitch mark information candidates is read from said voice waveform storage; and said read values are considered wholly, thereby to calculate a peak matching degree, so that a pitch mark candidate that takes the maximum peak matching degree is selected.

17. A method for analyzing voices according to claim 16, wherein said peak matching degree is a total of said read values.

* * * * *

UNITED STATES PATENT AND TRADEMARK OFFICE

CERTIFICATE OF CORRECTION

PATENT NO. : 6,349,277 B1
DATED : February 19, 2002
INVENTOR(S) : Kamai et al.

It is certified that error appears in the above-identified patent and that said Letters Patent is hereby corrected as shown below:

Title page,
Item [56], References Cited, U.S. PATENT DOCUMENTS, delete "5,774,995" and insert -- 5,774,955 --.

Signed and Sealed this

Fifteenth Day of April, 2003

JAMES E. ROGAN
*Director of the United States Patent and Trademark Office*